US010563274B1

(12) United States Patent
Strelbisky et al.

(10) Patent No.: US 10,563,274 B1
(45) Date of Patent: Feb. 18, 2020

(54) STAVE COOLER SYSTEM AND METHOD

(71) Applicant: Tallman Technologies Inc., Burlington (CA)

(72) Inventors: Michael J. Strelbisky, Burlington (CA); Goran Dimitrijevik, Oakville (CA)

(73) Assignee: Tallman Technologies Inc., Burlington, Ontario (CA)

( * ) Notice: Subject to any disclaimer, the term of this patent is extended or adjusted under 35 U.S.C. 154(b) by 157 days.

(21) Appl. No.: 15/702,013

(22) Filed: Sep. 12, 2017

Related U.S. Application Data

(60) Provisional application No. 62/393,149, filed on Sep. 12, 2016.

(51) Int. Cl.
*C21B 7/10* (2006.01)

(52) U.S. Cl.
CPC ..... *C21B 7/10* (2013.01)

(58) Field of Classification Search
CPC ..... C21B 7/10; F27B 1/12; F27B 1/14; F27D 1/004; F27D 1/04; F27D 1/06; F27D 1/12; F27D 2009/0027; F27D 2009/0067; F27D 9/00; F28D 2021/0056; F28D 2021/0078; F28D 7/08; F28F 1/00; F28F 9/02
USPC ..... 266/46, 190, 193, 44, 241, 168; 29/428; 165/168, 170, 169
See application file for complete search history.

(56) References Cited

U.S. PATENT DOCUMENTS

| | | | | |
|---|---|---|---|---|
| 2,345,188 A * | 3/1944 | Foell | C21B 7/10 122/6 B |
| 3,849,587 A | 11/1974 | Hatch et al. | |
| 10,259,084 B2 * | 4/2019 | Veenstra | F27D 9/00 |
| 2013/0316295 A1 * | 11/2013 | Maggioli | C21B 7/10 432/77 |

FOREIGN PATENT DOCUMENTS

| | | |
|---|---|---|
| JP | 2012158788 | 8/2012 |
| WO | 2012107322 A1 | 8/2012 |
| WO | 2015051455 A1 | 4/2015 |

OTHER PUBLICATIONS

Machine Generated English Language Translation of JP 2012158788.

* cited by examiner

*Primary Examiner* — Scott R Kastler
*Assistant Examiner* — Michael Aboagye

(57) ABSTRACT

A stave cooler system for cooling one or more cooling elements mounted in a metallurgical furnace. The system includes a stave cooler assembly having an inner end portion with an end part comprising a body and a number of fins extending from the body, each fin being formed to bend upon engagement of an outer part of each said fin respectively with an outer wall of the cooling element, to securely engage at least the outer part of each fin with an inner borehole wall partially defining the inner part when the end part is inserted into the inner part of the hole.

10 Claims, 23 Drawing Sheets

STAVE COOLER SYSTEM AND METHOD

CROSS-REFERENCE TO RELATED APPLICATIONS

This application claims the benefit of U.S. Provisional Patent Application No. 62/393,149, filed on Sep. 12, 2016, the entirety of which is hereby incorporated herein by reference.

FIELD OF THE INVENTION

The present invention is a stave cooler system for cooling a stave or cooling element mounted in a metallurgical furnace.

BACKGROUND OF THE INVENTION

In a metallurgical furnace (e.g., a blast furnace), cooling elements are typically provided to protect a lining or layer located between the burden and an outer shell of the furnace. For instance, in a blast furnace, the cooling elements (i.e., copper staves) may be used in the lower part of the stack, the belly, the bosh, and/or the hearth portions. The staves are, in part, intended to provide a heat removal or dispersal function by circulation of a coolant, through passages therein.

However, as is well known in the art, the staves deteriorate over time, and their cooling effectiveness deteriorates accordingly. In the harsh environment of the metallurgical furnace, the staves are subject to erosion or other damage to the extent that the staves are ultimately removed, in whole or in part. Typically, the cooling function of the staves continues until one or more of the passages therein are exposed, and the coolant ceases to circulate. This in turn may lead to overheating of the outer shell, requiring prompt repair.

The erosion of the staves may be localized, or it may be more general. If the staves' coolant passageway is breached, then the coolant's circulation must be shut off or significantly reduced, to avoid damage to the refractory lining and a possible catastrophic explosion. In these circumstances, it is necessary to either reduce output significantly, or to blow down the blast furnace, to remove and replace the damage stave or staves.

Replacement of staves and/or the refractory lining requires the metallurgical furnace to be shut down for a lengthy period of time. The production lost as a result typically represents a very large financial loss.

SUMMARY OF THE INVENTION

For the foregoing reasons, there is a need for a stave cooling system that overcomes or mitigates one or more of the disadvantages or defects of the prior art. Such disadvantages or defects are not necessarily included in those described above.

In its broad aspect, the invention provides a stave cooler system for cooling one or more cooling elements mounted in a metallurgical furnace. The cooling element of the system includes an inner part of a hole, the inner part being defined by an inner hole wall ending outwardly at an outer wall of the cooling element that is transverse to the inner hole wall. The system also includes a stave cooler assembly including an inner end portion having an end part with a body and a number of fins extending from the body, each fin having an outer part thereof and an inner part thereof connecting the outer part and the body. Each fin is formed to bend upon engagement of the outer part of each fin respectively with the inner hole wall at the outer wall, to securely engage at least the outer part of each fin with the inner hole wall when the end part is inserted into the inner part of the hole. The stave cooler assembly also includes an elongate central portion extending between distal and proximal ends thereof connected with the inner end portion at its distal end, an outer end portion secured to the central portion at the proximal end thereof, and one or more conduits extending through the central portion and the inner end portion, a fluid coolant being circulatable through the conduit, for transfer of heat generated in the metallurgical furnace from the cooling element to the coolant at least partially by conduction via the outer parts of the bent fins engaging the inner hole wall. The system also includes a source of the coolant.

In another of its aspects, the invention provides a method of cooling one or more cooling elements mounted in a metallurgical furnace. The cooling element is partially defined by an outer wall thereof. The method includes forming an inner part of a hole in the cooling element, the inner part being defined by an inner hole wall, the outer wall being located transverse to the inner hole wall. A stave cooler assembly is provided, which includes an inner end portion with an end part having a body and a number of fins extending from the body, each fin having an outer part thereof and an inner part thereof connecting the outer part and the body. Each fin is formed to bend upon engagement with the outer wall. The stave cooler assembly also includes an elongate central portion extending between distal and proximal ends thereof connected with the inner end portion at its distal end, an outer end portion secured to the central portion at the proximal end thereof, and one or more conduits in the central portion and the inner end portion through which a fluid coolant is circulatable, for transfer of heat generated in the metallurgical furnace from the cooling element to the coolant at least partially by conduction via the outer parts of the bent fins engaging the borehole wall. A source of the coolant is provided, for circulating the coolant through the conduit. The end part of the inner end portion is inserted into the hole in a predetermined inward direction, to engage the outer parts of the fins respectively with the inner hole wall, for bending the outer parts so that they are urged against the inner hole wall by the respective inner parts of the fins connected thereto to engage the inner hole wall.

BRIEF DESCRIPTION OF THE DRAWINGS

The invention will be better understood with reference to the attached drawings, in which:

FIG. 100 is a cross-section of another alternative embodiment of the stave cooler assembly of the invention including another embodiment of the positioning assembly of the invention, drawn at a smaller scale;

DETAILED DESCRIPTION

Figure 1:
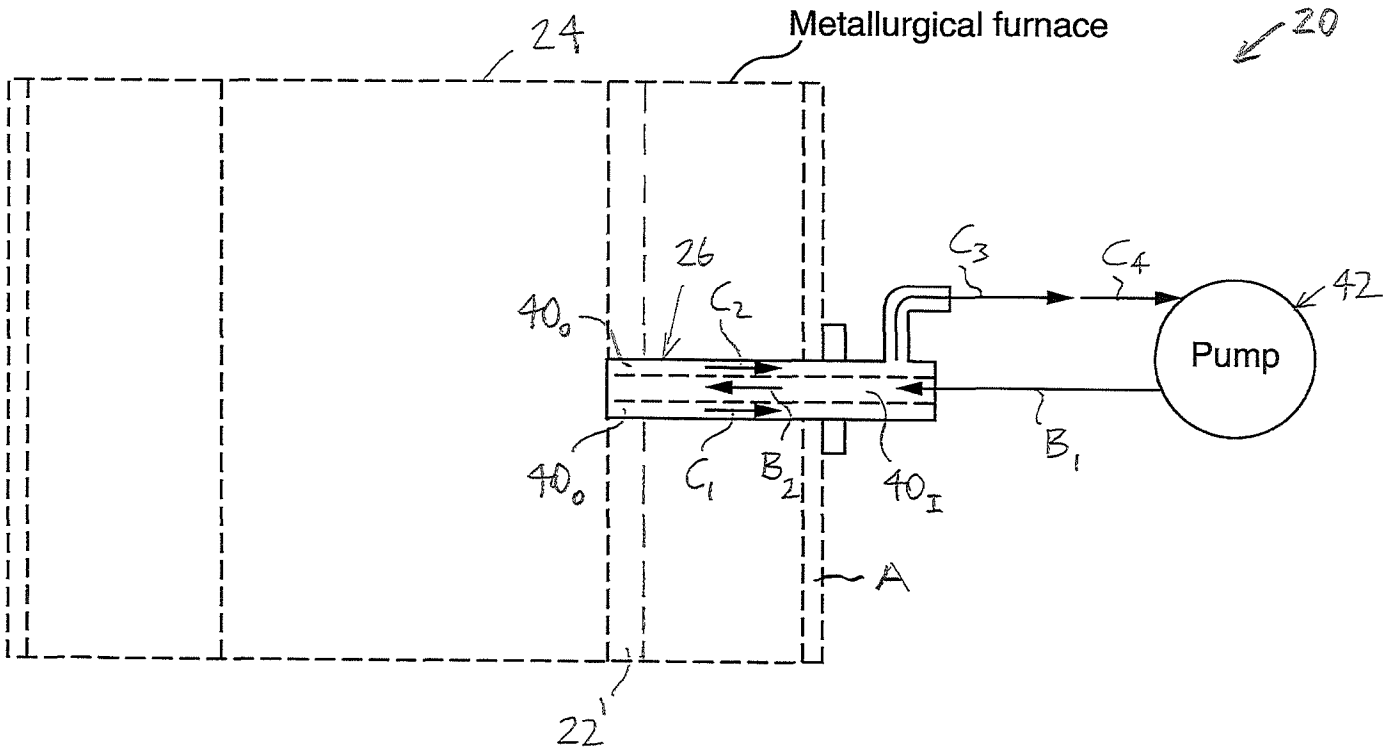
FIG. 1 is a schematic illustration of an embodiment of a stave cooler system of the invention.

In the attached drawings, like reference numerals designate corresponding elements throughout. Reference is first made to FIGS. 1-10C to describe an embodiment of a stave cooler system of the invention indicated generally by the numeral 20. The stave cooler system 20 is for cooling one or more cooling elements (i.e., staves) 22 mounted in a metallurgical furnace 24 (FIG. 1).

Figure 2:
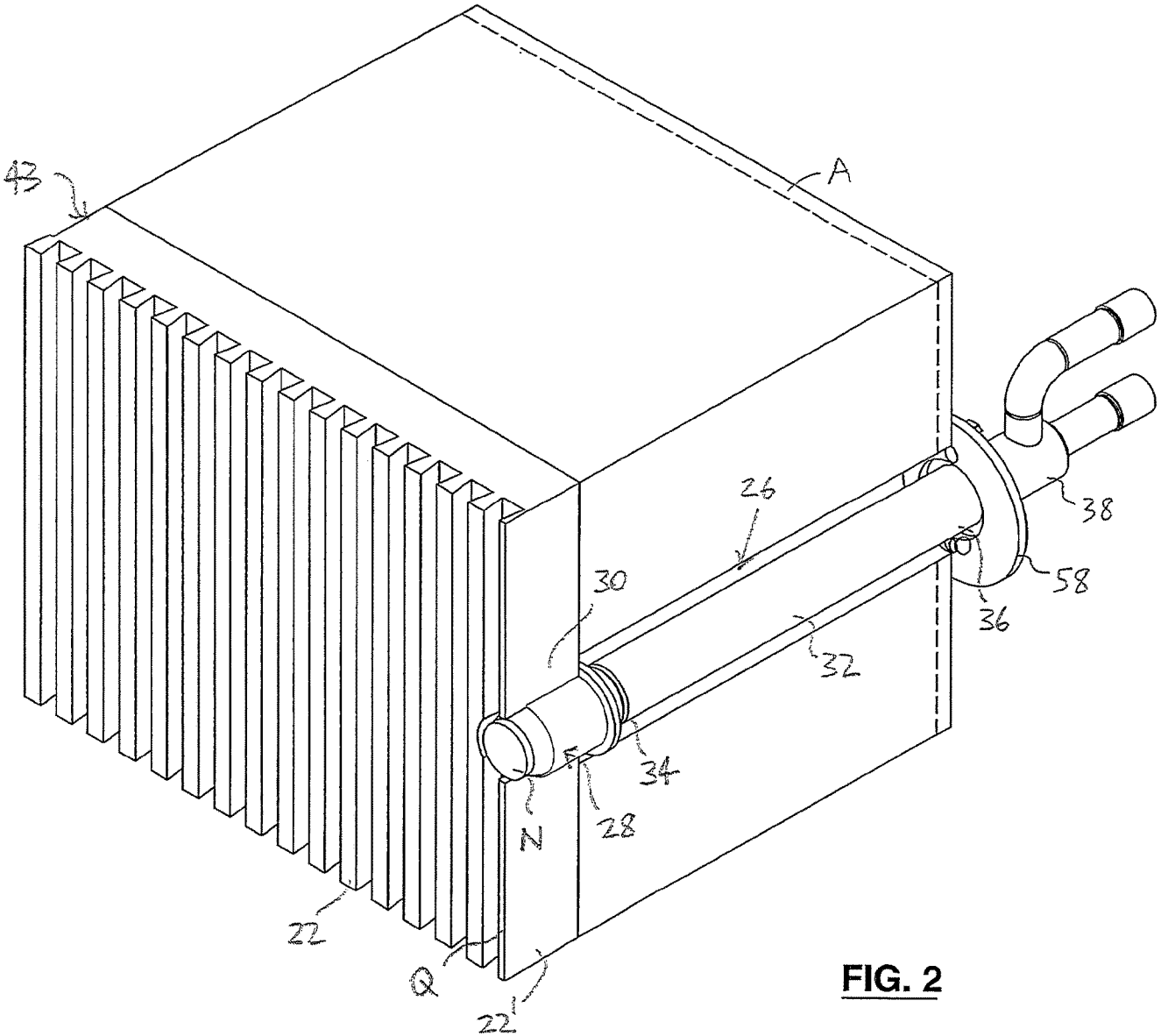
FIG. 2 is an isometric view of an embodiment of a stave cooler assembly of the invention positioned in a stave, drawn at a larger scale.
Figure 3:
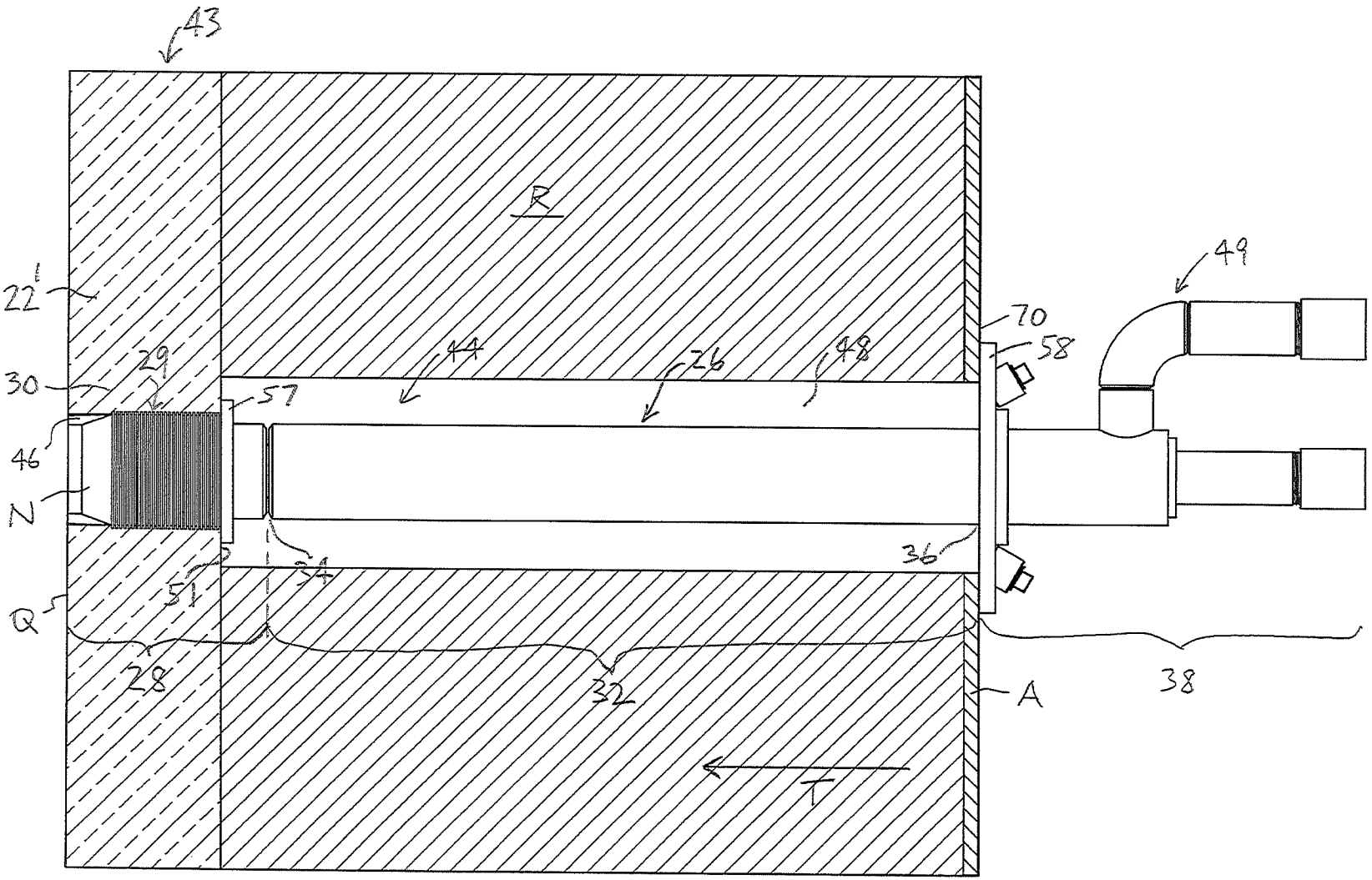
FIG. 3 is a cross-section of the stave and a side view of the stave cooler assembly of FIG. 2, drawn at a larger scale.

As will be described, the cooling element 22 of the system 20 preferably includes an inner part 46 of a hole 44 therein, and the inner part 46 of the hole 44 is at least partially defined by an inner hole wall 50. The inner hole wall 50 ends outwardly at an outer wall 51 of the cooling element or stave 22 that is transverse to the inner hole wall 50. In one embodiment, the system 20 preferably also includes a stave cooler assembly 26 (FIGS. 1-3).

As can be seen in FIGS. 2, 3, 5, 6, and 7A, it is preferred that the stave cooler assembly 26 includes an inner end portion 28 having an end part 29 including a body 54 and a number of fins 52 extending from the body 54. As will also be described, each fin 52 preferably includes an outer part 83 thereof, and an inner part 84 thereof connecting the outer part 83 and the body 54 (FIGS. 4B, 4C). It is preferred that each of the fins 52 is formed to bend upon engagement of the outer part 83 with the inner hole wall 50 at the outer wall 51, to securely engage at least the outer part 83 of each fin 52 with the inner hole wall 50 when the end part 29 is inserted into the inner part 46 of the hole 44.

Figure 6:
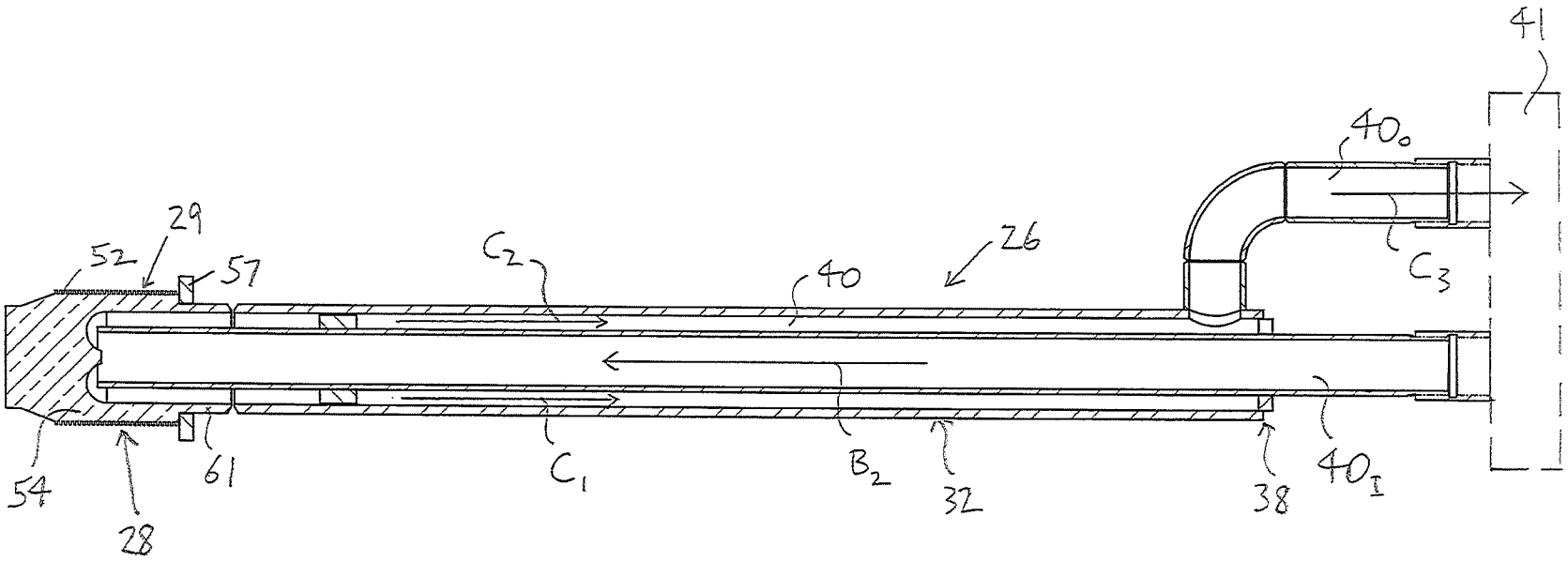
FIG. 6 is a cross-section of the stave cooler assembly of FIG. 5.

Preferably, the stave cooler assembly 26 also includes an elongate central portion 32 extending between distal and proximal ends thereof 34, 36, connected with the inner end portion 28 at its distal end 34. As will be described, the stave cooler assembly 26 preferably also includes an outer end portion 38 secured to the central portion 32 at its proximal end 36 thereof (FIG. 6). As can also be seen in FIGS. 6 and 7, and as will be described, the stave cooler assembly 26 preferably includes one or more conduits 40 therein through which a fluid coolant (not shown) is circulatable, for transfer of heat generated in the metallurgical furnace 24 from the stave 22 to the coolant at least partially by conduction via the outer parts 83 of the bent fins 52 engaging the inner hole wall 50. It is also preferred that the system 20 includes a source 41 of the coolant.

It will be understood that the coolant may be circulated by any suitable means. For instance, in one embodiment, the system 20 preferably also includes a pump assembly 42, for circulating the coolant through the conduit. However, the coolant may be circulated by other means (e.g., by a heat pump system).

The stave cooler assembly 26 may be retrofitted. In one embodiment, the stave cooler assembly 20 preferably is installed in the stave assembly 43 that is already in position, i.e., inside the metallurgical furnace 24. This is illustrated in FIGS. 1-10A. In general, the ability of a stave (or of a stave assembly that includes a number of staves) to dissipate heat generated in the metallurgical furnace decreases over time, due to its physical deterioration. When the passage in the stave through which the coolant circulates is breached, the stave or cooling element no longer performs a cooling function. The stave cooler system 20 prolongs the useful life of the stave or stave assembly by providing targeted cooling of selected staves.

For clarity, a selected one of the staves (i.e., cooling elements) into which the inner end portion 28 of the stave cooler assembly 26 is located is identified by reference numeral 22'. As can be seen in FIG. 2, the stave or cooling element 22' preferably is included in a stave assembly 43, which includes a number of staves. It will be understood that, depending on the extent of the deterioration of the staves, several of the stave cooler assemblies 26 may be installed in a particular stave assembly 43. However, only one stave cooler assembly 26 is shown in FIG. 2, for clarity of illustration. The stave cooler assembly 26 preferably is installed in the selected stave 22' for heat transfer away from the part 30 of the selected stave 22' that appears to be deteriorating relatively rapidly, i.e., compared to other staves in the stave assembly 43.

Once a stave or cooling element has been identified as requiring repair, the hole 44 is formed, including the inner part 46 thereof (FIG. 3), in which the end part 29 of the inner end portion 28 of the stave cooler assembly 26 is receivable. It will be understood that the inner hole wall 50 has an area thereof that partially defines the inner part 46 of the hole 44. As will be described, after the inner part 46 of the hole 44 is formed in the cooling element 22', the end part 29 preferably is inserted into the hole 44. A direction of travel in which the stave cooler assembly 26 is moved in order to insert the end part 29 into the inner part 46 of the hole 44 is schematically illustrated by arrow "T" in FIG. 3.

The hole 44 may be substantially circular in cross-section, with different diameters at different points along its length. In particular, in one embodiment, the inner part 46 of the hole 44 may be substantially circular in cross-section along its length. As will be described, in an alternative embodiment, the inner part 46 may be slightly tapered (i.e., conical, or frustoconical) along its length, or only at its innermost end.

Figure 4A:
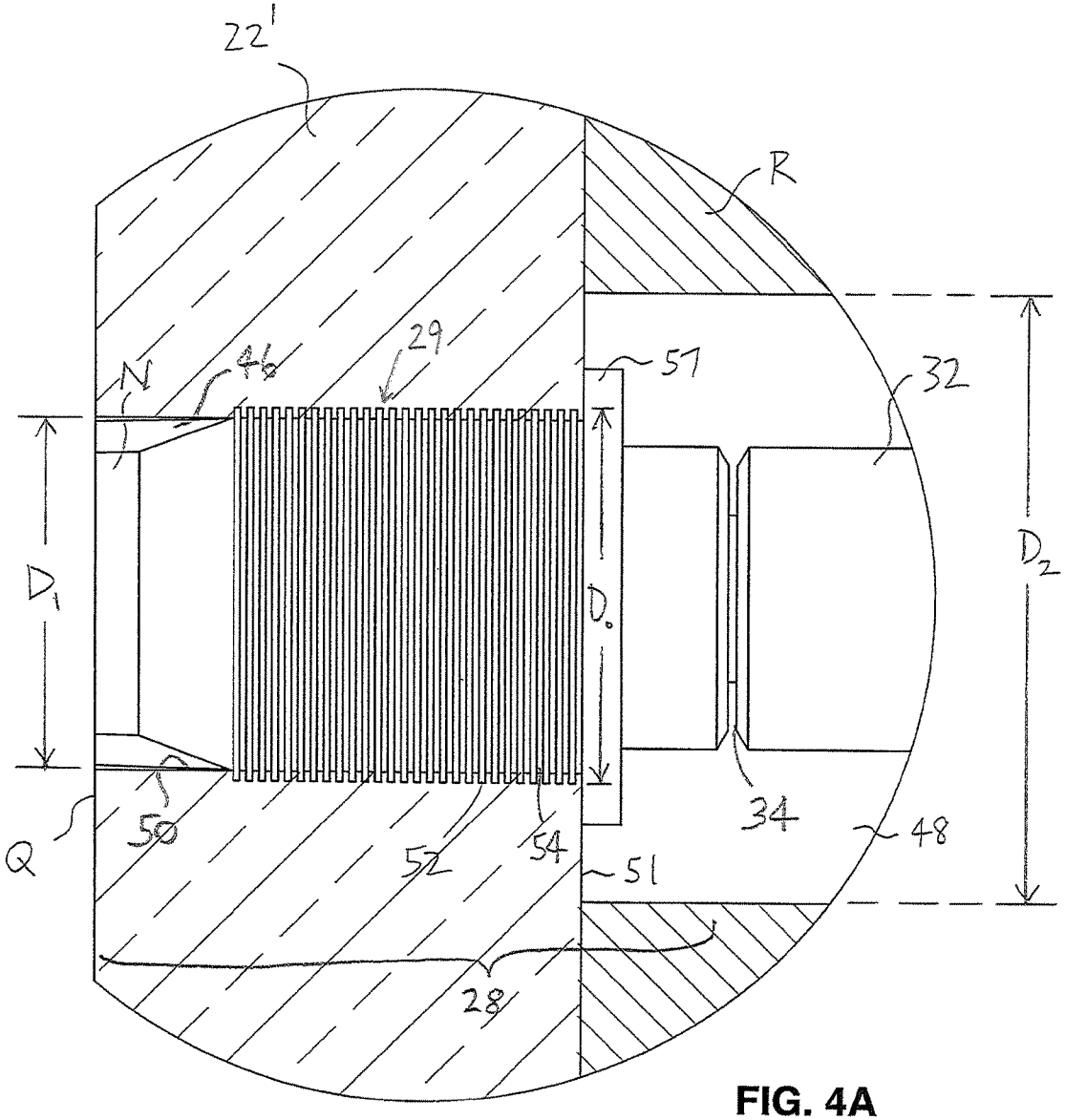
FIG. 4A is a portion of the cross-section and side view of FIG. 3, drawn at a larger scale.
Figure 4B:
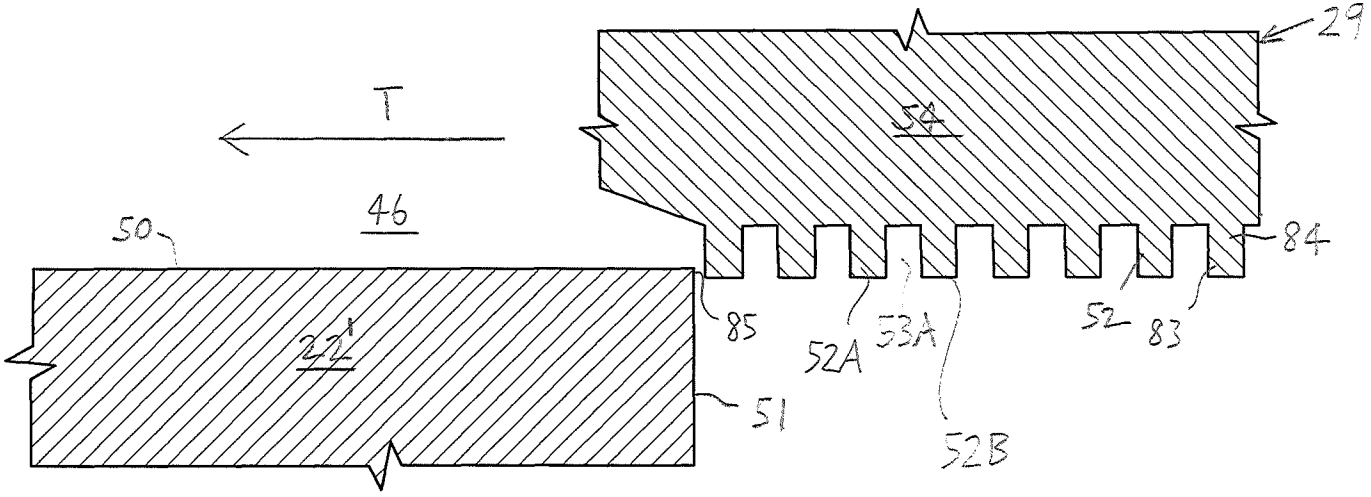
FIG. 4B is a partial cross-section of an end part of an inner end portion of the stave cooler assembly of FIGS. 1-4A prior to insertion of the end part into an inner part of a hole in the stave, drawn at a larger scale.
Figure 4C:
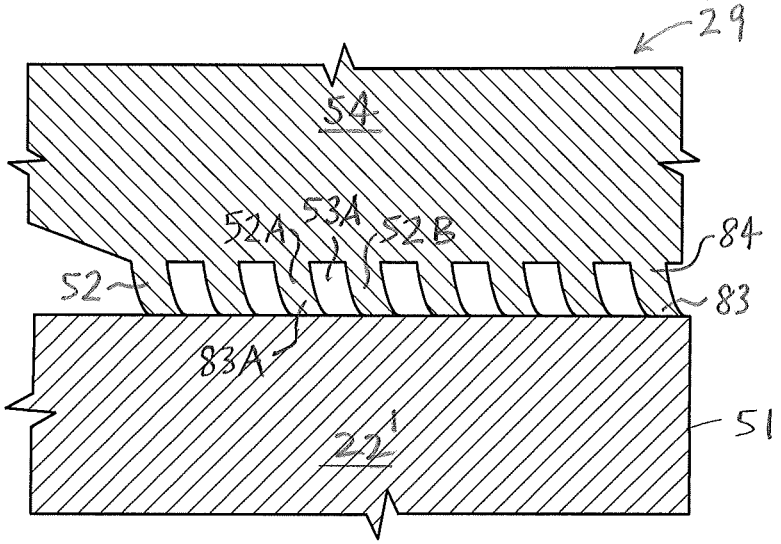
FIG. 4C is a cross-section of a segment of the end part of the inner end portion after insertion thereof in the inner part of the hole showing fins thereof bent and engaged with an inner hole wall defining the inner part.

In the example illustrated in FIGS. 1-4A, a refractory lining "R" is positioned between a shell "A" of the metallurgical furnace 24 and the stave assembly 43. The hole 44 preferably includes an outer part 48 thereof located in the refractory lining "R" and the inner part 46 thereof located in the stave or cooling element 22' (FIG. 3). As can be seen in FIG. 4A, the inner part 46 preferably has a diameter "$D_1$" that is smaller than a diameter "$D_2$" of the outer part 48. The inner part 46 is partially defined by an inner hole wall 50 (FIGS. 4A, 4B). The outer wall 51 of the stave or cooling element 22 is located at the transition from the outer part 48 of the hole 44 to the inner part 46 of the hole 44 (FIG. 3). As can be seen in FIGS. 3 and 4A-4C, the outer wall 51 is substantially planar, and is located transverse to the inner hole wall 50.

It will be understood that the arrangement of the stave assembly 43 and the refractory lining "R" illustrated in FIGS. 1-3 is exemplary only. Other arrangements (e.g., arrangements in which the refractory lining "R" is omitted) are possible.

As can be seen in FIG. 2, it is preferred that an external segment 49 of the outer end portion 38 of the stave cooler assembly 26 is positioned outside the metallurgical furnace 24. As shown in FIG. 1, the external segment 49 is connected to the pump assembly 42. The external segment 49 is located outside the shell "A" to facilitate connecting the external segment 49 to the pump assembly 42. The pump assembly 42 causes the coolant to circulate through the stave cooler assembly 26, as will be described.

Those skilled in the art would appreciate that the coolant may be any suitable fluid, i.e., the coolant may be any suitable liquid or gas, or any suitable combination or mixture thereof.

In FIG. 3, the stave cooler assembly 26 is shown in its inserted position, in which the end part 29 of the inner end portion 28 is securely engaged with the selected stave or cooling element 22', and the external segment 49 is located outside the shell "A" of the metallurgical furnace 24.

In one embodiment, the inner end portion 28 preferably is made of a suitable material having high thermal conductivity, e.g., copper. As will be described, it is preferred that the inner end portion 28 is formed so that the end part 29 thereof securely engages at least a portion of the inner hole wall 50, when the stave cooler assembly 26 is inserted into the hole 44. As noted above, it is preferred that the secure engagement is implemented via the fins 52, the outer parts 83 of which are bent when the end part 29 is inserted into the inner part 46 of the hole 44, so that the outer parts 83 are urged against the inner hole wall 50 by the inner parts 84 when the end part 29 is fully inserted. The secure engagement of the end part 29 of the inner end portion 28 with the inner hole wall 50 facilitates transfer of heat by conduction from the stave or cooling element 22' (in which the inner part 46 of the hole 44 is formed) to coolant moving through the end part 29.

The end part 29 preferably includes the fins 52 located on the body 54 thereof (FIG. 4A). It is also preferred that the fins 52 initially (i.e., before insertion of the body 54 and the fins 52 of the inner end portion 28 into the inner part 46 of the hole 44) define an outer diameter "Do" of the end part 29 that is slightly larger than the diameter "$D_1$" of the inner part 46, which is defined by the inner hole wall 50. Also, the body 54 preferably has a diameter "$D_B$" that is slightly less than the diameter "$D_1$" of the inner part 46 of the hole 44 (FIG. 7).

As noted above, each fin 52 includes the inner part 84 thereof attached to or integrally formed with the body 54, and the outer part 83 thereof connected with the inner part 84. The outer part 83 is distal to the body 54, and the inner part 84 is proximal to the body 54. As can be seen in FIG. 4B, before the fins 52 are bent, they are positioned substantially orthogonal to the direction of travel, schematically indicated by arrow "T" in FIG. 4B. Prior to the fins 52 being bent upon insertion, the fins 52 are also positioned substantially orthogonal to the inner hole wall 50.

Figure 7A:
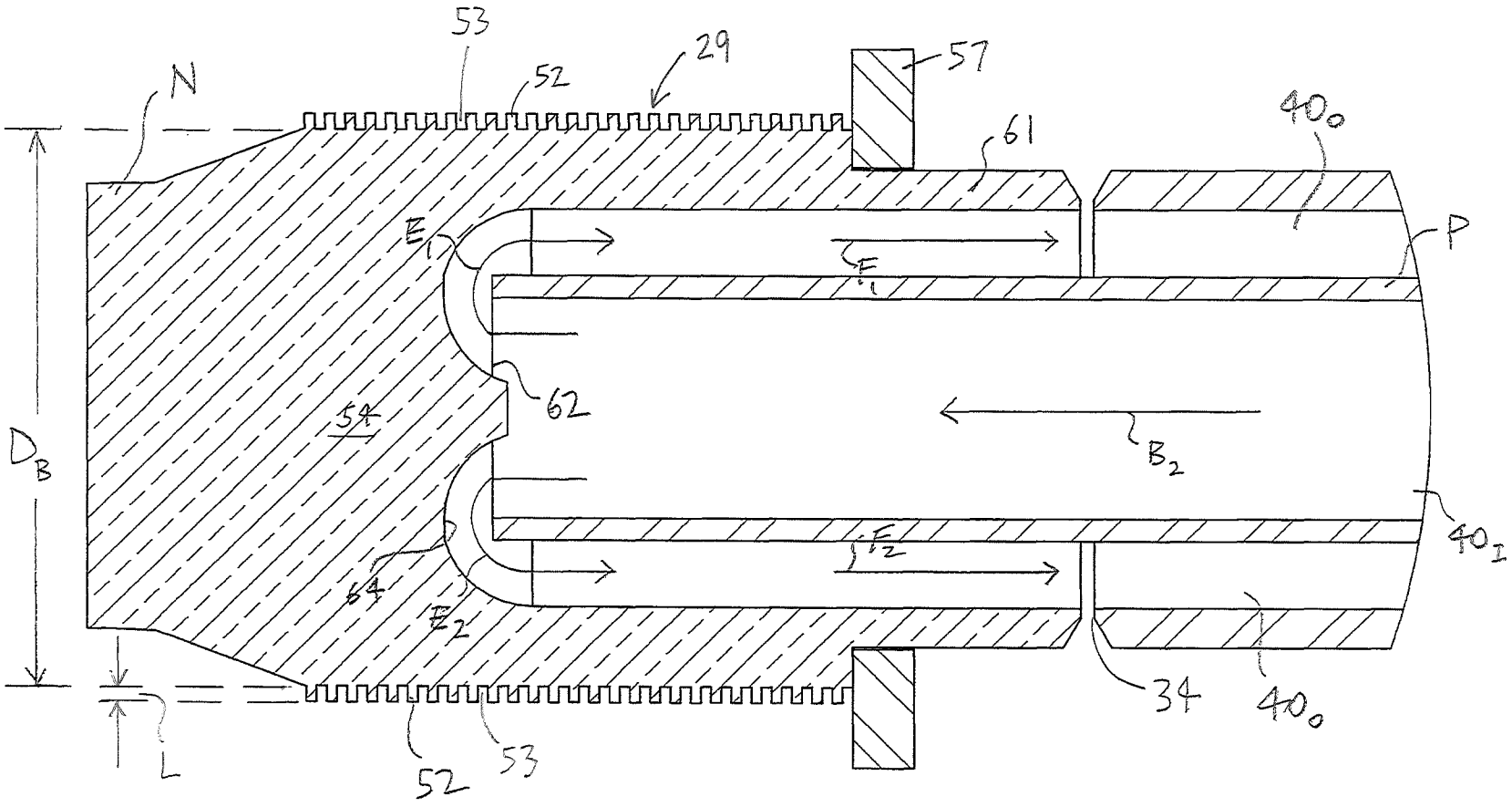
FIG. 7A is a cross-section of an inner end portion and part of a central portion of the stave cooler assembly of FIG. 6, drawn at a larger scale.

As can be seen in FIGS. 4B and 7A, prior to the fins 52 being bent and inserted into the inner part 46, the fins 52 preferably are separated from each other by gaps 53. The gaps 53 preferably are a predetermined size that is sufficient to permit the fins 52 to be bent upon insertion, as will be described.

As the end part 29 of the inner end portion 28 is inserted into the inner part 46, the fins 52 preferably respectively engage the outer wall 51 just before they enter the inner part 46 of the hole 44, and the fins 52 are bent as a result (FIG. 4C). The end part 29 immediately prior to its insertion into the inner part 46 of the hole 44 is shown in FIG. 4B. The end part 29 after its insertion, with the fins 52 bent, is shown in FIG. 4C. It will be understood that, when the fin 52 is bent and the end part 29 is in the inner part 46, the outer part 83 of each fin 52 is bent in a direction generally away from the direction of travel, and the inner part 84 remains at least partially positioned substantially orthogonal to the direction of travel. It will be understood that the outer part 83 of each fin 52, once bent and located in the end part 46, is urged against the inner hole wall 50 by the inner part 84 to which it is connected, due to spring back.

As can be seen, e.g., in FIGS. 4B and 4C, when the outer part 83 of a particular fin is bent generally outwardly, the outer part 83 is moved, at least in part, into the gap 53 that is between that fin and the fin positioned next outwardly. For clarity of illustration, two adjacent fins are identified in FIGS. 4B and 4C as 52A and 52B respectively. The fins 52A and 52B are separated by the gap or spacing therebetween, identified for convenience by reference character 53A. As can be seen in FIGS. 4B and 4C, when the outer part 83A of the fin 52A is bent outwardly, the outer part 83A is forced into the region between the fins 52A, 52B. In particular, it will be understood that, as the end part 29 is inserted into the inner part 46, there is a point at which the fin 52A is bent, but the fin 52B is not yet bent. The gap 53A is required to be sufficiently large to accommodate the outer part 83A after the fin 52A has been bent, but before the fin 52B is bent.

It will be understood that, for clarity of illustration, the fins 52 and the gaps 53 therebetween are drawn so that the fins are illustrated in FIGS. 4B and 4C as being relatively short, and (in FIG. 4C) as being only slightly bent. In FIGS. 4B and 4C, the similarity of the fins 52 and the gaps 53 is exaggerated for illustrative purposes.

Figure 4D:
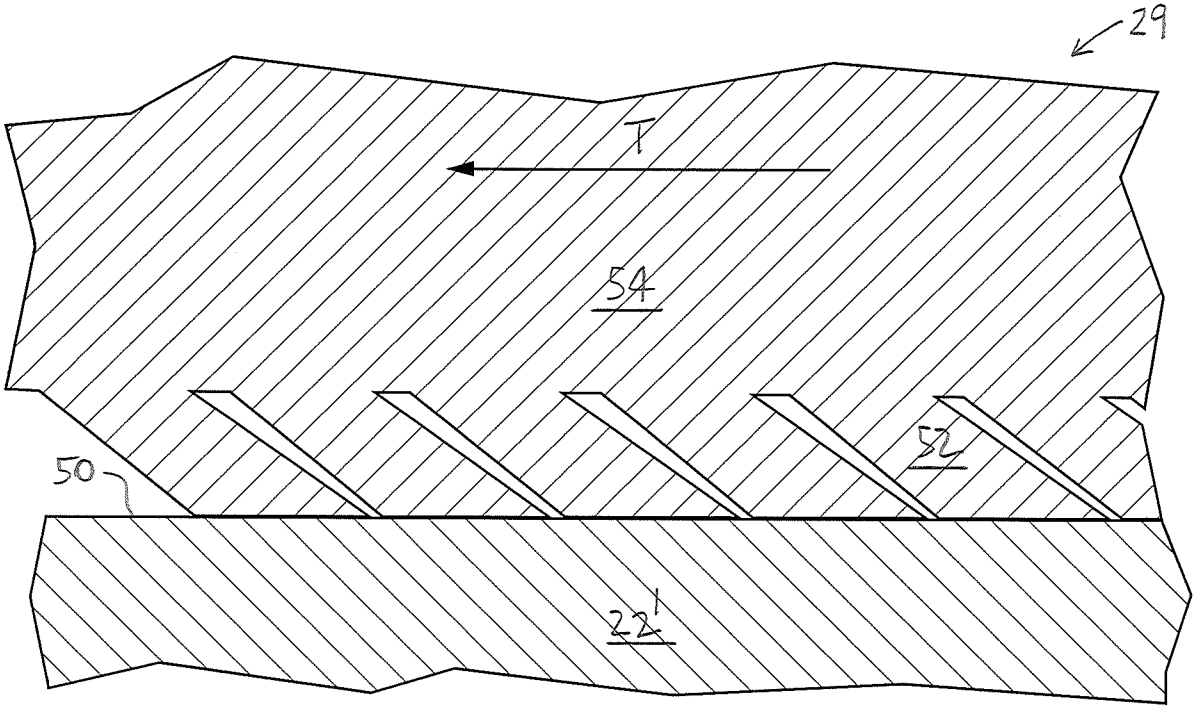
FIG. 4D is a cross-section of a segment of another embodiment of the stave cooler assembly of the invention showing the bent fins engaging the inner hole wall.
Figure 5:
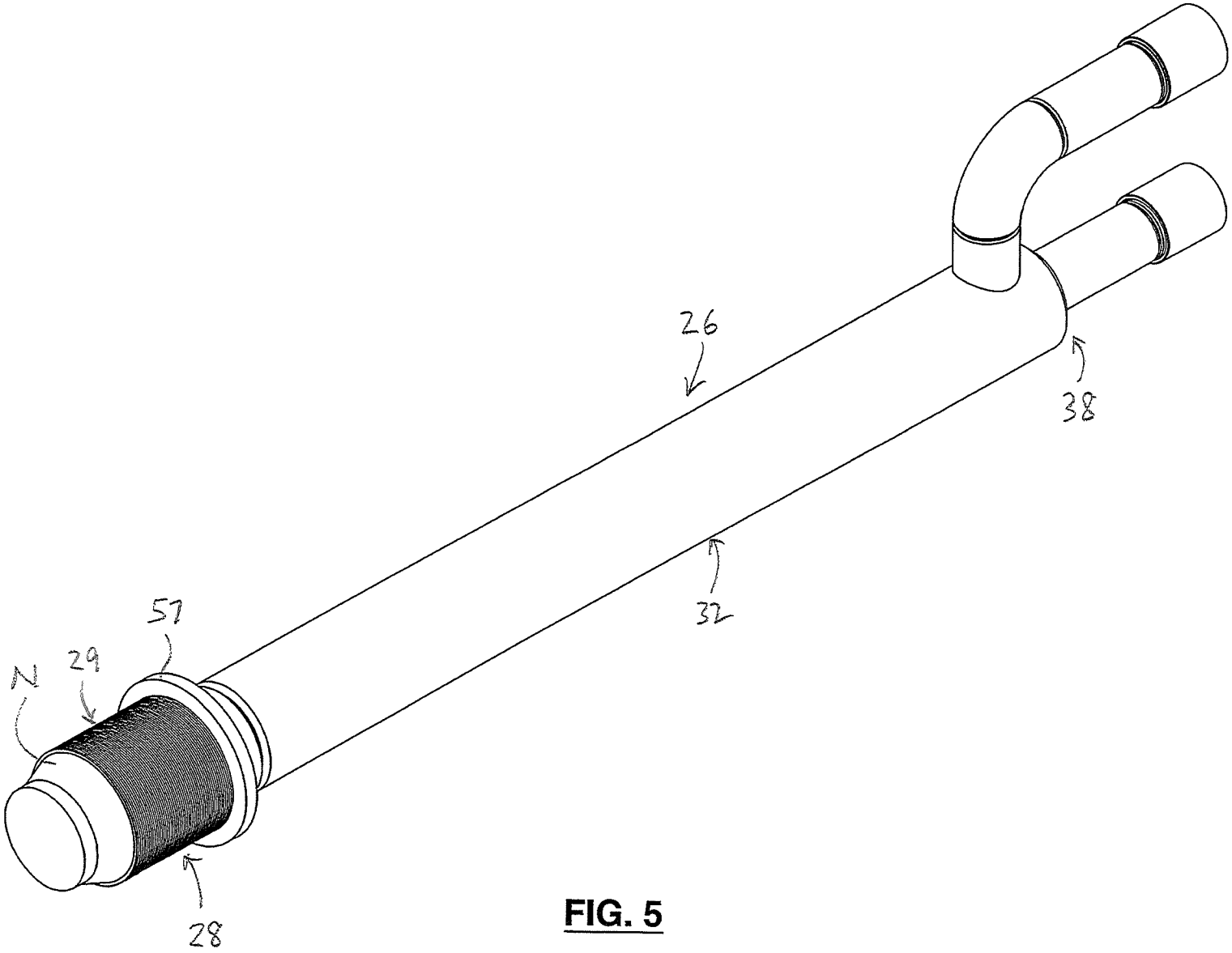
FIG. 5 is an isometric view of the stave cooler assembly of FIG. 2, drawn at a smaller scale.

In FIG. 4D, the fins 52 are shown after they have been bent, i.e., after the end part 29 has been inserted into the inner part 46 of the hole 44. Compared to FIG. 4C, FIG. 4D provides a more realistic illustration of the extent to which the inner hole wall 50 is engaged by the bent fins 52. As can be seen in FIG. 4D, it is preferred that almost the entire area of the inner hole wall 50 is engaged by the bent fins 52. Preferably, more than 50% of the area of the inner hole wall 50 is engaged by the bent fins 52. In practice, it has been found that far more than 50% of the area of the inner hole wall 50 is actually engaged by the bent fins 52. For instance, at least 70% of the area of the inner hole wall 50 is engaged by the bent fins (FIG. 4D). As can be seen in FIG. 4D, between approximately 90% and approximately 95% of the area of the inner hole wall 50 may be engaged by the bent fins 52.

It is desirable to maximize the area of the inner hole wall that is engaged by the bent fins 52, so as to maximize the extent to which heat may be transferred by conduction from the cooling element 22' to the coolant via the fins 52 and the body 54 of the end part 29. As can be seen in FIG. 4D, almost the entire bent fin 52 (i.e., the outer part 83, and a portion of the inner part 84, of each fin 52) preferably is engaged with the inner hole wall 50.

It will be understood that, when the end part 29 is inserted into the inner part 46 of the hole 44, the end part 29 is approximately at room temperature. As is known, when a relatively thin piece of a metal is bent at room temperature, the piece will be subjected to both plastic and elastic deformation. The mechanisms involved in connection with the manner in which the fins 52 engage the inner hole wall 50 have not been analyzed, however, it is believed that, as the end part 29 is inserted into the inner part 46, each fin 52 is subjected to plastic deformation, but each fin 52 is at the same time subjected to elastic deformation, to a limited extent. Due to the plastic deformation thereof, the fins 52 are generally bent outwardly, as can be seen, e.g., in FIG. 4C. However, due to the elastic deformation of the fins 52, as the end part 29 enters the inner part 46 of the hole 44, the inner part 84 of each fin 52 urges the outer part 83 against the inner hole wall 50. Also, once the end part 29 is positioned in the inner part 46, the outer part 83 is urged against the inner hole wall 50. Accordingly, it will be understood that, when the end part 29 is positioned in the inner part 46, the fins 52 as illustrated in FIG. 4C are both plastically and elastically deformed. Because of the unreleased elastic deformation, or unreleased "spring back", the outer parts 83 are urged against the inner hole wall 50 by the respective inner parts 84 connected to them.

Because the fins 52 are relatively thin, and preferably are made of copper, the outer parts 83 thereof are relatively easily bent. The fins 52 are sized so that the amount of force required to bend the fins, and to push the end part 29 into the inner part 46 in the direction of travel "T", although substantial, is not sufficiently great to cause the central portion 32 to buckle.

It will be understood that the sizing of the fins 52, and the spacing or gaps 53 between the fins 52, is determined based on a number of factors. For example, as the end part 29 is inserted into the inner part 46, a predetermined portion of each of the fins 52 engage a part 85 of the outer wall 51. Those skilled in the art would appreciate that the part 85 preferably extends sufficiently far from the inner hole wall 50 to cause sufficient simultaneous plastic and elastic deformation of the fins 52. However, it will also be understood that the amount of force required to be applied in the direction of travel indicated by arrow "T" at the outer end portion 38, to push the end part 29 into the inner part 46, preferably should be minimized, to the extent feasible. Among the relevant factors are the dimensions of the fins 52 and the extent to which the area 85 extends outwardly or away from the inner hole wall 50. The density of the material out of which the fins are made, i.e., copper, is also taken into account.

It is important that the amount of force required to be applied to move the end part 29 inwardly, in the direction "T", fully into the inner part 46 be limited because of the risk that the stave 22, and/or pre-existing connections of pipes carrying coolant (not shown) to and from the stave 22, may be damaged, if excessive force is used to push the end part 29 into the inner part 46 of the hole 44. For instance, it is possible that the stave 22 may be dislodged from its location, if too much force is required to position the end part 29 into the inner part 46 of the hole 44, which is formed in the stave 22.

Because of this, it is preferred that the size and shape of the fins 52, and their spacing from each other (i.e., the gaps 53), is predetermined so that the end part 29 may be inserted into the inner part 46 and the end part 29 may be securely held therein, without excessive force being required that may damage other elements. However, those skilled in the art would appreciate that a certain amount of force is required, in order to securely engage the fins 52 of the end part 29 against the inner hole wall 50.

As can be seen in FIG. 7A, in one embodiment, prior to them being bent as described above (i.e., upon insertion of the end part 29 into the inner part 46), the fins 52 each extend from the body by the same distance "L". Also, it is preferred that the gaps 53 between the fins 52 are substantially uniform.

Figure 7B:
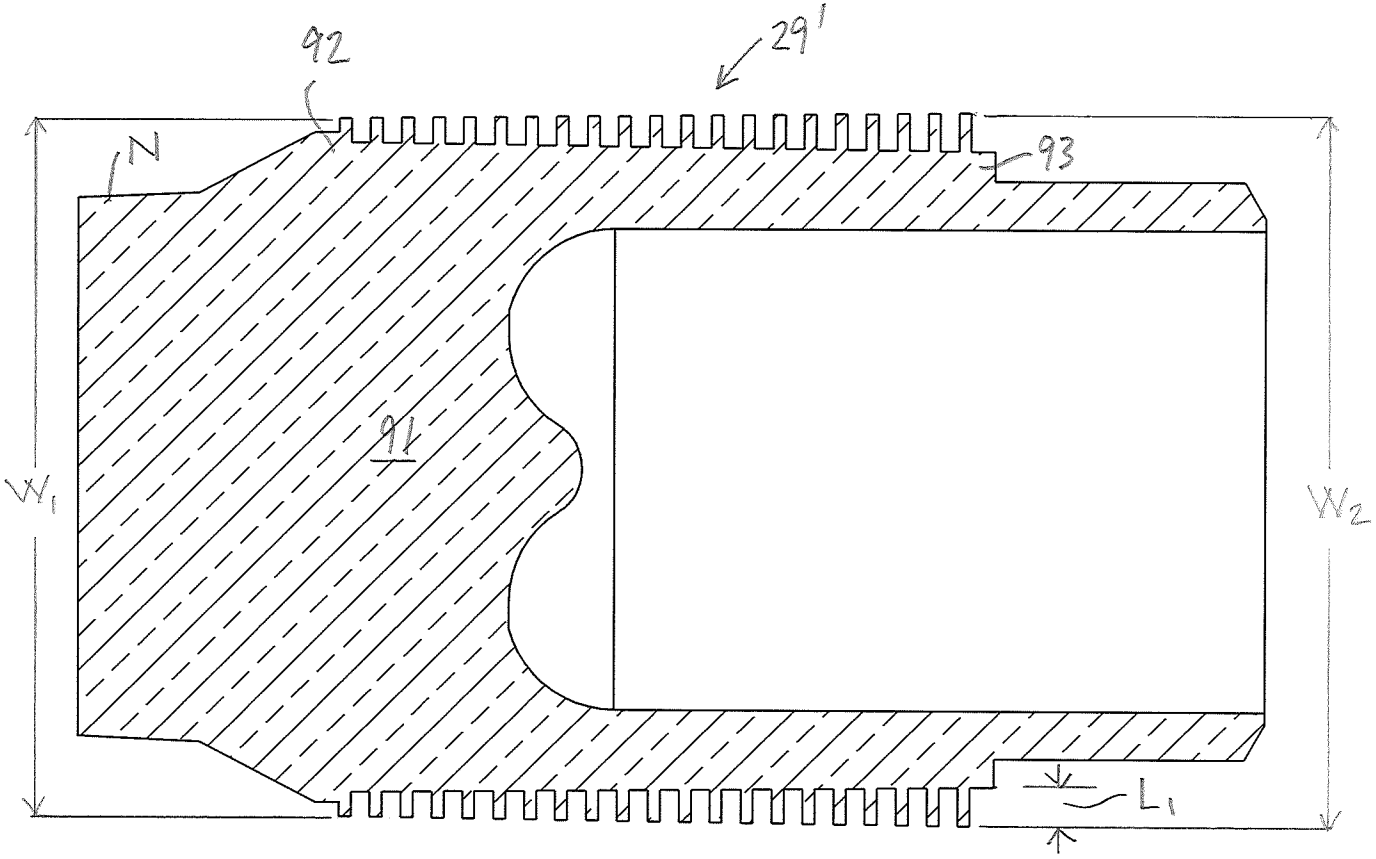
FIG. 7B is a cross-section of an alternative embodiment of an end part of the inner end portion of the invention, drawn at a smaller scale.
Figure 8:
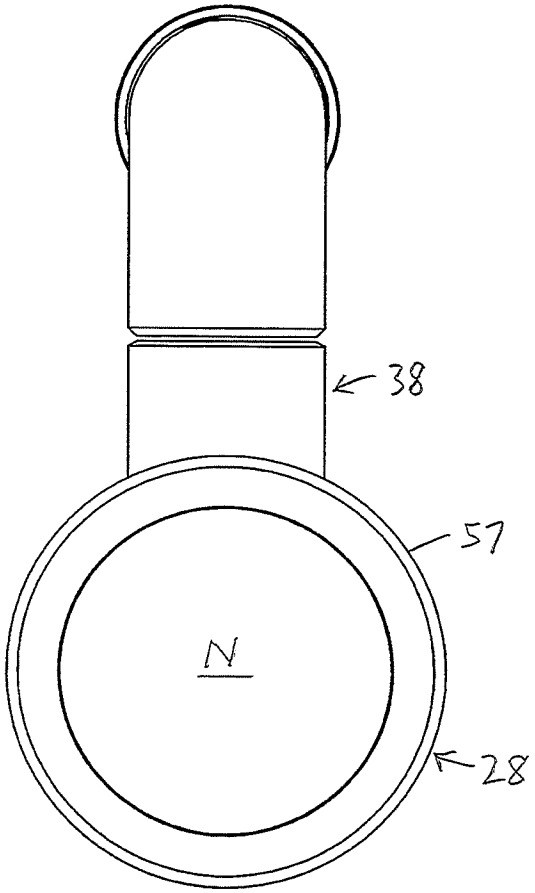
FIG. 8 is an end view of the stave cooler assembly of FIG. 2 from the inner end portion, drawn at a smaller scale.

As can be seen in FIG. 7B, the body 54 preferably includes a main part 91 to which the nose "N" is attached. The main part 91 extends between an inner end 92 thereof, which is adjacent or proximal to the nose "N", and an outer end 93 thereof, which is distal to the nose "N".

In an alternative embodiment of the end part 29', illustrated in FIG. 7B, the lengths "$L_1$" of the fins 52 extending outwardly from the body, prior to the fins being bent, preferably vary along a length of the end part 29', from the inner end 92 of the main part 91 to the outer end 93 of the main part 91. That is, and as can be seen in FIG. 7B, the fins 52 are tapered to extend gradually further outwardly (from the main part 91), from the inner end 92 to the outer end 93 of the main part 91. It will be understood that, in FIG. 7B, the end part 29' is illustrated prior to its insertion into the inner part 46 (i.e., prior to the fins 52 being bent).

In FIG. 7B, the outer diameter of the end part 29' at the inner end 92 is identified as "$W_1$". The outer diameter of the end part 29' at the outer end 93 is identified as "$W_2$". The end part 29' is shown in FIG. 7B prior to its insertion into the inner part 46 of the hole 44. As can be seen in FIG. 7B, it is preferred that "$W_2$" is greater than "$W_1$". Preferably, the difference between "$W_1$" and "$W_2$" is at least partially due to the fins 52 having different respective predetermined lengths "$L_1$". It is preferred that the lengths "$L_1$" of the fins 52 gradually increase along the length of the main part 91, from the inner end 92 to the outer end 93. It is believed that, due to the respective predetermined lengths "$L_1$" of the fins 52 gradually increasing from the inner end 92 to the outer end 93, the initial insertion of the end part 29 into the inner part 54 is relatively easier than inserting an outer portion 94 of the end part 29, i.e., at which the lengths "$L_1$" of the fins 52 are longer.

Those skilled in the art would appreciate that the dimensions of the inner part 46 of the hole 44, and also the dimensions of the fins 52, may be any suitable dimensions. For instance, where the inner part 46 has a diameter of 3.5 inches, it is preferred that the outer diameter "$W_1$" of the fins at the inner end 91 prior to insertion is approximately 3.625 inches. It is also preferred that the outer diameter "$W_2$" of the fins 52 at the outer end 93 prior to insertion is approximately 3.70 inches.

From FIG. 4B, it can be seen that the area 85 of the outer wall 51 that is engaged by the outer parts 83 of the fins 52 as the end part 29 is pushed into the inner part 46 preferably varies. For example, if the inner and outer diameters "$W_1$", "$W_2$" are as described above, when the insertion commences, approximately 0.125 inches (i.e., 3.625 minus 3.500). When the insertion is almost complete, and the fins 52 at the outer end 93 engage the area 85, approximately 0.20 inches (3.70 inches minus 3.50 inches) of the fin engages the outer wall 51.

As noted above, the fins 52 may have any suitable thickness, and the gaps 53 may be any suitable size. As an example, the fins 52 may be, for example, approximately 0.063 inches thick, and the gaps 53 may be approximately 0.097 inches wide.

Accordingly, it is preferred that the fins 52 are bent upon engagement with the part 85 of the outer wall 51 as the end part 29 is inserted into the inner part 46, and the outer parts 83 thereof are urged against the inner hole wall 50 at least partially due to spring back in each fin while the body 54 of the inner end portion 28 is positioned in the inner part 46, to securely engage the inner hole wall 50.

It will be understood that, in FIGS. 3 and 4A, for clarity of illustration, the fins 52 are not shown as having been bent. It will also be understood that the fins 52 are omitted from FIG. 2 for clarity of illustration.

It will be understood that, in the foregoing example, the inner part 46 is round in cross-section, and has a diameter of approximately 3.50 inches. As will be described, in an alternative embodiment, the tapered end part 29' may alternatively be inserted into an inner part of the hole 44 that is tapered, in whole or in part.

An advantage of the embodiment of the system 20 as described above is that the secure engagement of the fins 52 with the inner hole wall 50 is obtained via a relatively simple mechanism, i.e., bending of the fins 52 for secure engagement with the inner hole wall 50, as the end part 29 of the inner end portion 28 is inserted into the inner part 46 of the hole 44. As noted above, secure engagement of the end part 29 of the inner end portion 28 (i.e., the fins 52) with the inner hole wall 50 is desirable in order to permit relatively efficient heat transfer by conduction from the stave or cooling element 22' to the coolant moving through the inner end portion 28, via the fins 52 and the body 54.

As schematically illustrated in FIG. 1, the coolant preferably is moved into an input conduit $\mathbf{40}_I$, the direction of movement of the coolant therein being indicated by arrows "$B_1$", "$B_2$". The input conduit $\mathbf{40}_I$ is in fluid communication with an output conduit $\mathbf{40}_O$, through which the coolant flows (as indicated by arrows "$C_1$"-"$C_4$" in FIG. 1) to return to the pump assembly 42. The circulation of the coolant through the input and output conduits $\mathbf{40}_I$, $\mathbf{40}_O$ is also schematically illustrated by arrows "$B_2$", "$C_1$"-"$C_3$" in FIG. 6 and by arrows "$B_2$", "$C_1$", and "$C_2$" in FIG. 7.

As noted above, the coolant may be circulated by any suitable means. It will be understood that, once the coolant is returned to the pump assembly 42 or other moving means from the output conduit $\mathbf{40}_O$, the coolant is cooled at the pump assembly 42 or other moving means before being returned to the input conduit $\mathbf{40}_I$. Suitable means for cooling the coolant would be known to those skilled in the art. As can be seen in FIGS. 6 and 7, the cooled coolant flows inwardly through the input conduit $\mathbf{40}_I$ (i.e., through the outer end portion 38 and through the central portion) to the inner end portion 28 via the input conduit $\mathbf{40}_I$.

As can be seen in FIG. 7A, in one embodiment, the inner end portion 28 preferably includes a barrel part 61 integrally formed with the body 54. As shown in FIG. 3, when the stave cooler assembly 26 is in the inserted position, the barrel part 61 is at least partially positioned in the outer part 48 of the hole 44.

The input conduit $\mathbf{40}_I$ preferably is defined by a tube or pipe "P" (FIGS. 6, 7A). In one embodiment, and as can be seen in FIG. 6, the pipe "P" extends continuously through the central portion 32 between the outer end portion 38 and the inner end portion 28. In FIG. 7A, it can be seen that the pipe "P" preferably extends into the body 54 of the end part 29 of the inner end portion 28.

Near an inner end 62 of the input conduit $\mathbf{40}_I$, the coolant that is moving inwardly and exiting the input conduit $\mathbf{40}_I$ is redirected outwardly by an internal surface 64 of the inner end portion 28, as indicated by arrows "$E_1$" and "$E_2$" in FIG. 7A. The redirected coolant flows through the output conduit $\mathbf{40}_O$, as indicated by arrows "$F_1$", "$F_2$", and ultimately exits via the output conduit $\mathbf{40}_O$ at the outer end portion 38 (FIGS. 1, 6).

From the foregoing, it can be seen that the coolant, if properly cooled before sent into the input conduit $\mathbf{40}_I$, dissipates heat from the stave or cooling element 22'. As the coolant flows through the inner end portion 28, heat transferred from the stave or cooling element 22' to the inner end portion 28 by conduction is at least partially further transferred to the coolant, primarily by conduction. Accordingly, the stave cooler system 20 removes heat from the stave or cooling element 22', thus facilitating further transfer of heat from the interior of the metallurgical furnace to the cooling element 22'.

Figure 9:
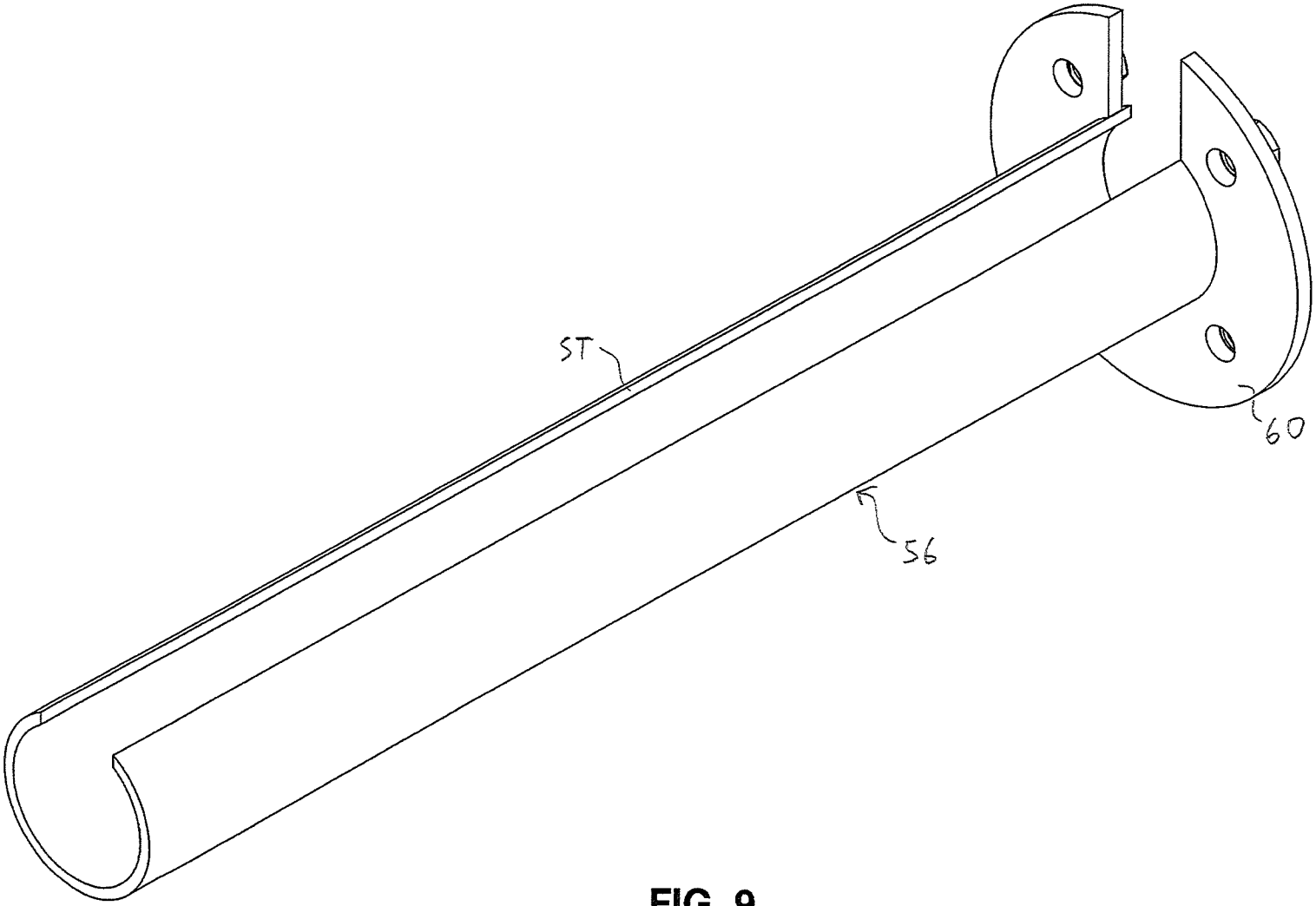
FIG. 9 is an isometric view of an embodiment of a sleeve element of the invention, drawn at a larger scale.
Figure 10A:
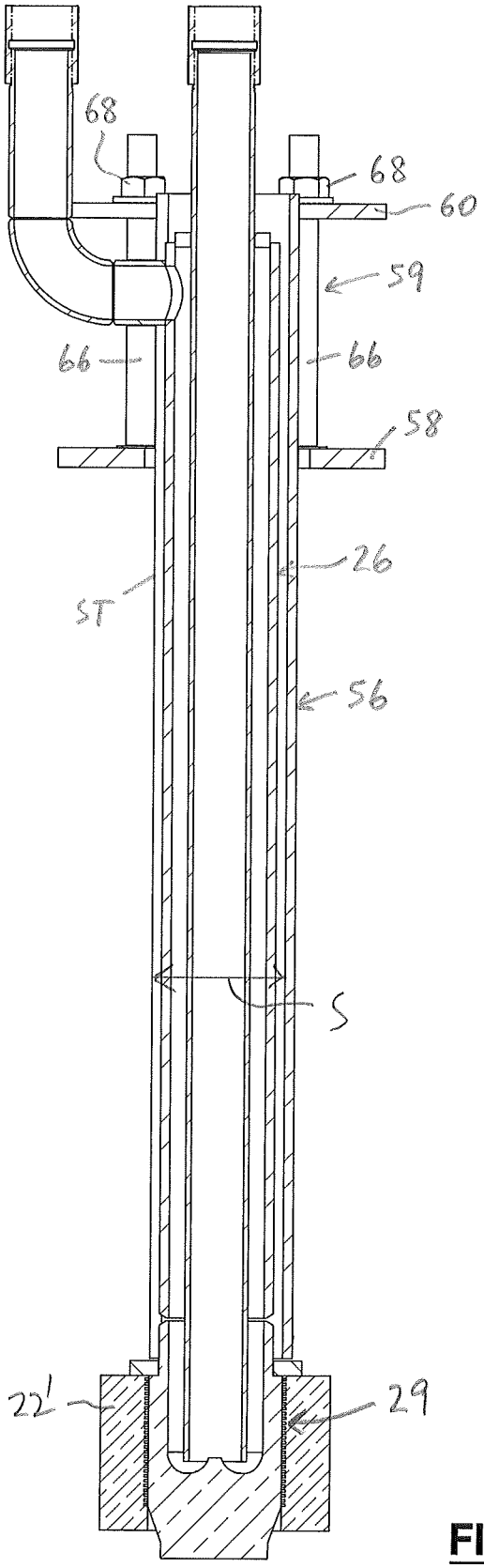
FIG. 10A is a cross-section of the stave cooler assembly of the invention including the sleeve element of FIG. 9, drawn at a smaller scale.

To facilitate the movement of the stave cooler assembly 26 into the hole 44 during installation, it is preferred that the system 20 also includes a sleeve element 56 (FIGS. 9, 10A). The sleeve element 56 includes a slotted tube "ST". As can be seen, e.g., in FIG. 10A, the slotted tube "ST" preferably has a relatively large internal diameter ("S"), so that it can accommodate the inner and central portions 28, 32 and part of the outer end portion 38. It will be understood that the outer diameter of the sleeve element 56 is slightly smaller than the diameter "$D_2$" of the outer part 48 of the hole 44.

The sleeve element 56 protects the stave cooler assembly 26 while the stave cooler assembly 26 is partially inserted into the hole 44. During insertion of the stave cooler assembly 26, the sleeve element 56 preferably is extended only into the shell "A" and the refractory lining "R", and does not push into the inner part 46 of the hole 44 in the stave 22'.

In one embodiment, the body 54 preferably includes a tapered nose "N" (FIGS. 4A, 7A), to facilitate installation. As can be seen in FIG. 4A, it is preferred that, when the stave cooler assembly 26 is in the inserted position, the nose "N" does not extend beyond the exposed wall "Q" of the selected stave 22'.

As can be seen in FIGS. 3, 6, and 7A, the inner end portion 28 preferably includes a flange 57 that is located to position the inner end portion 28 so that the nose "N" is in the desired position therefor, when the stave cooler assembly 26 is in the inserted position. In one embodiment, the stave cooler assembly 26 preferably is inserted by pushing it inwardly (i.e., in the direction indicated by arrow "T" in FIG. 3) until the flange 57 engages the outer wall 51 of the stave 22', preventing further inward movement. For example, in one embodiment, the sleeve element 56 engages the flange 57 (as shown in FIG. 10A), and the sleeve element 56 is pushed inwardly until the flange 57 engages the outer wall 51 of the cooling element. It will be understood that in this embodiment the end part 29 is made to fit lengthwise in the inner part 46 of the hole 44 in the stave or cooling element 22' so that, when the flange 57 prevents further movement inwardly of the stave cooler assembly 26 during insertion in the direction indicated by arrow "T" (FIG. 3), the nose "N" is in its predetermined position relative to the stave or cooling element 22'.

As can be seen in FIGS. 2 and 3, in one embodiment, the system 20 preferably includes an inner collar 58 for securing the stave cooler assembly 26 to the shell "A" of the furnace 24, once the stave cooler assembly 26 is in its inserted position. The sleeve element 56 preferably also includes an outer collar 60 (FIGS. 9, 10) to facilitate pushing the sleeve element 56 inwardly. After the inner and central portions 28, 32 and a part of the outer end portion 38 are in position in the hole 44, the sleeve element 56 is removed, to leave the stave cooler assembly 26 in the inserted position in the hole 44, as shown in FIG. 3.

It will be understood that a number of elements are omitted from the drawings, for clarity of illustration. For example, there typically is a bellows or similar element mounted between the inner end portion 28 and the outer end portion 38, in order to provide a substantially airtight seal between the inner end portion 28 and the outer end portion 38.

Various means may be used to push the sleeve element 56 into the refractory lining "R". Those skilled in the art would be aware of suitable mechanisms and devices. For instance, as illustrated in FIG. 10A, in one embodiment, the stave cooler assembly 26 preferably is pushed into the refractory lining "R" by a subassembly 59 including bolts 66 threadably moved by turning nuts 68 engaged with the bolts 66. (It will be understood that threads are omitted from the illustrations of the bolts 66 in FIG. 10A for clarity of illustration.)

Alternatively, the sleeve element 56, secured by the collars to the stave cooler assembly 26, may be pushed into the refractory material "R" by one or more hydraulic rams (not shown) secured to an outside surface 70 of the shell "A" of the furnace 24.

In an alternative embodiment, the end part 29 may have threads (not shown) instead of the fins, for threadable engagement with corresponding threads (not shown) on the inner hole wall 50, so that rotation of the inner end portion 28 (e.g., by rotation of the outer end portion 38) causes movement of the end part 29 further into the hole 44, until the stave cooler assembly 26 is in its inserted position.

From the foregoing, it can be seen that the invention includes, in one embodiment, an embodiment of a method of mounting the stave cooler assembly 26 for partial engagement thereof with the selected one of the staves 22' located in the metallurgical furnace 24. Preferably, the method includes forming the inner part 46 of the hole 44 having the predetermined diameter "$D_1$" in a preselected part 30 of the selected one of the staves or cooling elements 22'. The end part 29 is then inserted into the inner part 46 of the hole 44, to engage the end part 29 with the inner hole wall 50 in the selected one of the staves or cooling elements.

Those skilled in the art would appreciate that, due to temperature differences between the end part 29 (through which the coolant is circulated) and the cooling element or stave 22', in some circumstances, the engagement of the end part 29 (i.e., engagement of the outer parts 83 of the fins 52 of the end part 29) with the inner hole wall 50 may be lost, at least in part. To some extent, these temperature differences may arise because, when the end part 29 is first inserted into the inner part 46, the temperature of the stave 22' is somewhat lower than during normal operating conditions. However, once the end part 29 is installed in the inner part 46 and the furnace is operating normally, the stave 22' may become relatively warm, while the end part 29' remains relatively cool, due to the coolant circulated therethrough. The result may be that the inner part 46 of the hole 44 expands due to the heating of the stave 22', while the end part 29 does not experience a commensurate expansion. Accordingly, in one embodiment, the stave cooler system 20 preferably includes one or more positioning assemblies 86 for holding the inner end portion 28 in the hole 44, for heat transfer from the cooling element 22' to the coolant via the end part 29.

Figure 10B:
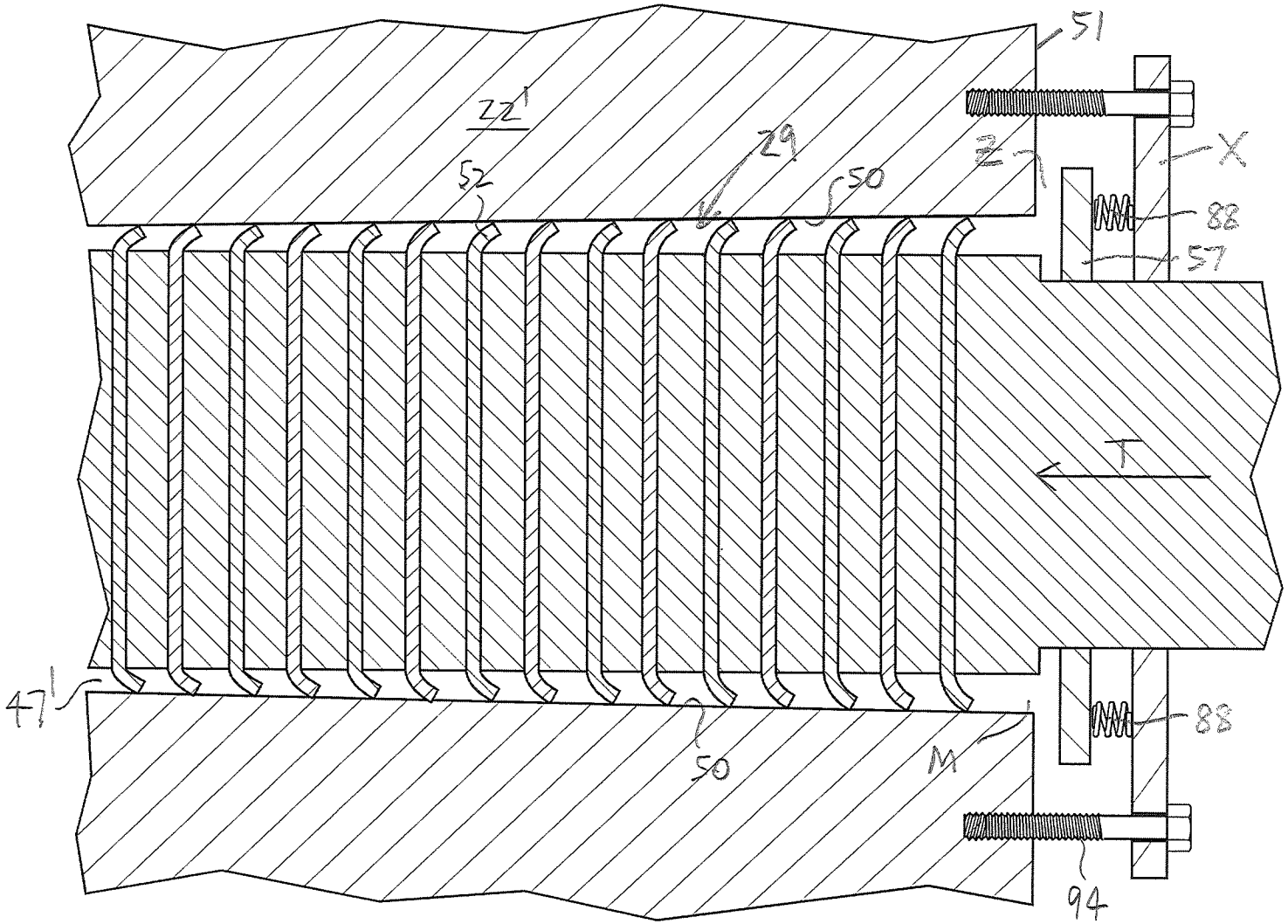
FIG. 10B is a cross-section of an embodiment of an end part of the inner end portion of the invention including an embodiment of a positioning assembly of the invention, drawn at a larger scale.
Figure 10C:
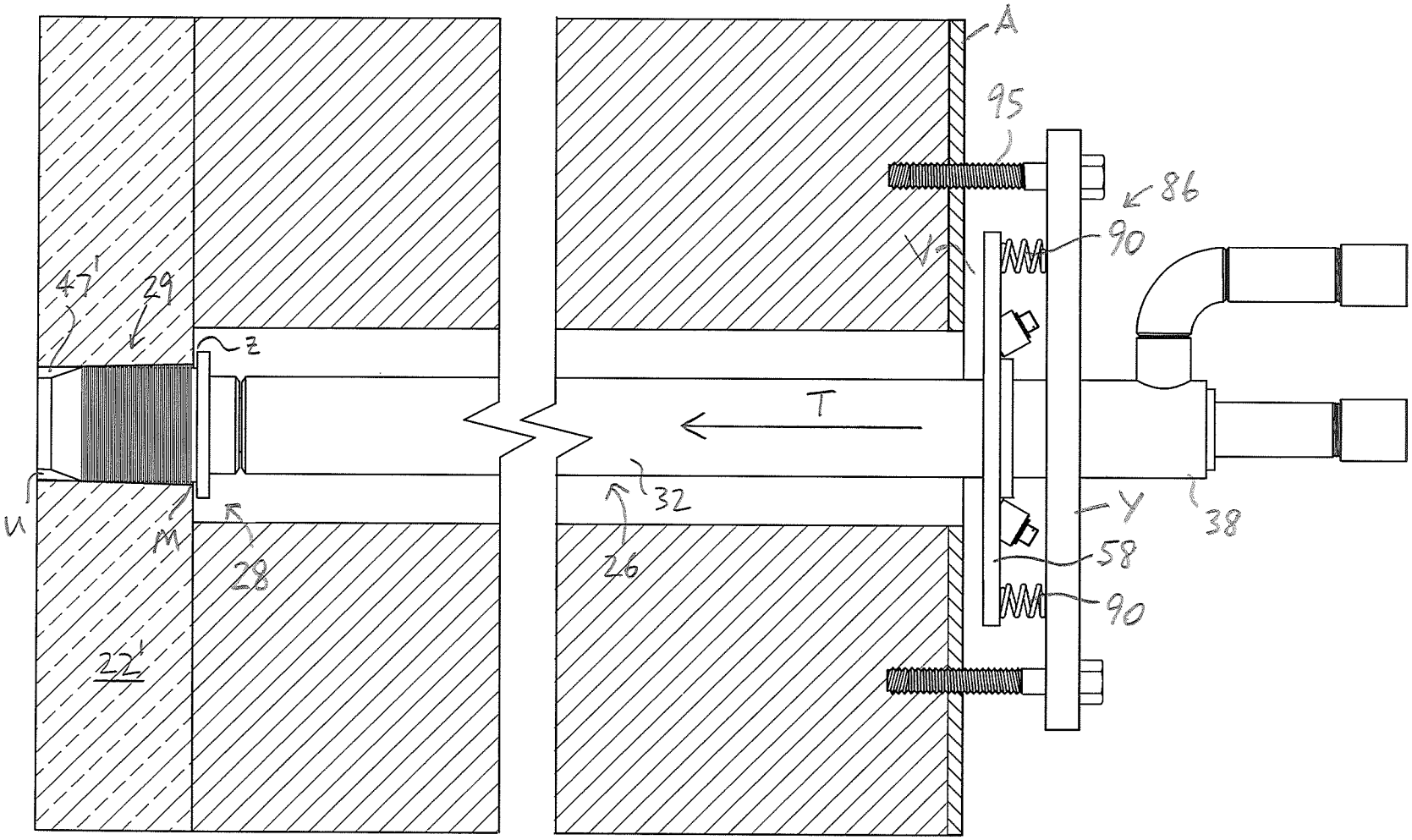

As can be seen in FIG. 10B, the positioning assembly 86 may include one or more inner positioning elements 88 located between the flange 57 and an inner plate "X" that is secured to the cooling element 22'.

As can be seen in FIG. 10B, in one embodiment, the inner part 46' of the hole 44 preferably is formed so that it is tapered, at least in part, at an inner segment 47' of the inner part 46'. Due to such tapering, the inner part 46' preferably is, at least in part, narrower at its innermost end "U" than in other portions of the inner part 46'.

As illustrated in FIGS. 10B and 100, the tapered segment 47' extends between the inner end "U" and an outer end "M" of the inner part 46'. However, it will be understood that the inner part 46' may be only partly tapered (i.e., the tapered segment extending from the inner end "U" to a point intermediate between the inner and outer ends "U", "M"), and partly round in cross-section (i.e., the round or cylindrical segment extending from the outer end "M" to the point intermediate between the inner and outer ends "U", "M"). It will also be understood that the end part 46' is illustrated as being tapered along its length in FIG. 10B for clarity of illustration.

In one embodiment, the inner part 46' is tapered along its length, and the end part 29' is also tapered. In a further alternative embodiment, the extent to which each of the inner part 46' and the end part 29' are tapered is substantially the same. Alternatively, the end part 29 (i.e., not tapered) may be inserted into the inner part 46', which (as noted above) may be tapered in whole, or in part.

Accordingly, as illustrated in FIG. 10B, the inner part 46' preferably includes the tapered segment 47' thereof in which a diameter of the tapered segment 47' increases from the inner end "U" of the inner part 46' outwardly. Alternatively, the inner part 46' preferably includes the tapered segment 47' thereof extending between the inner end "U" and the outer end "M" of the inner part 46', and a diameter of the tapered segment increases from the inner end "U" to the outer end "M".

In one embodiment, the end part 29 preferably is sized so that, once it is fully inserted into the inner part 46', there is a gap "Z" between the flange 57 and the outer wall 51.

The inner positioning elements 88 may be compression springs, pushing against the flange 57 and the inner plate "X" to hold the end part 29' in the inner part 46'. The inner plate "X" preferably is secured to the stave 22' by suitable fasteners 94. Preferably, the inner positioning elements 88 urge the flange 57 inwardly relative to the cooling element 22', to maintain the end part 29' in the inner part 46' of the hole 44. The inward direction is indicated by arrow "T" in FIG. 10B. It will be understood that the inner positioning elements 88 may be any suitable elements that push against the inner plate "X" and the flange 57 to urge the flange 57 inwardly.

From the foregoing, it can be seen that, in the event of a tendency of the end part 29' to disengage from the inner hole wall 50 due to temperature differences, the end part 29' is maintained in the inner part 46' by the inner positioning elements 88 of the positioning assembly 86.

It will be understood that the conduits in the inner end portion 28 are omitted from FIG. 10B for clarity of illustration.

It will also be understood that the positioning assembly 86 may be used where the inner part 46 has the same diameter throughout. Also, the positioning assembly 86 may be used whether the fins are tapered (as illustrated in FIG. 7B) or not (as illustrated in FIG. 7A).

In another alternative embodiment, the positioning assembly 86 preferably includes one or more outer positioning elements 90. Preferably, the collar 58' is positioned to define a gap "V" between the collar 58' and the shell "A". In one embodiment, it is also preferred that the end part 29' is positioned in the inner part 46' so that there is the gap "Z" between the flange 57 and the outer wall 51.

The outer positioning elements 90 preferably are located between the inner collar 58 and an outer plate "Y". The outer plate "Y" preferably is secured to the shell "A" by fasteners 95. The outer positioning elements 90 may be any suitable elements, e.g., compression springs. The outer positioning elements 90 preferably urge the collar 58 inwardly, to maintain the end part 29 in the inner part 46 of the hole 44. The inward direction is indicated by arrow "T" in FIG. 100. It will be understood that the outer positioning elements 90 may be any suitable elements that push against the outer plate "Y" and the collar 58 to urge the collar 58 inwardly.

From the foregoing, it can be seen that, in the event of a tendency of the end part 29' to disengage from the inner hole wall 50 due to temperature differences, the positioning assembly 86 and the outer positioning elements 90 maintain the end part 29' in the inner part 46'.

It will also be understood that, in an alternative embodiment, the positioning assembly 86 may include both the inner positioning elements 88 and the outer positioning elements 90.

Figure 11:
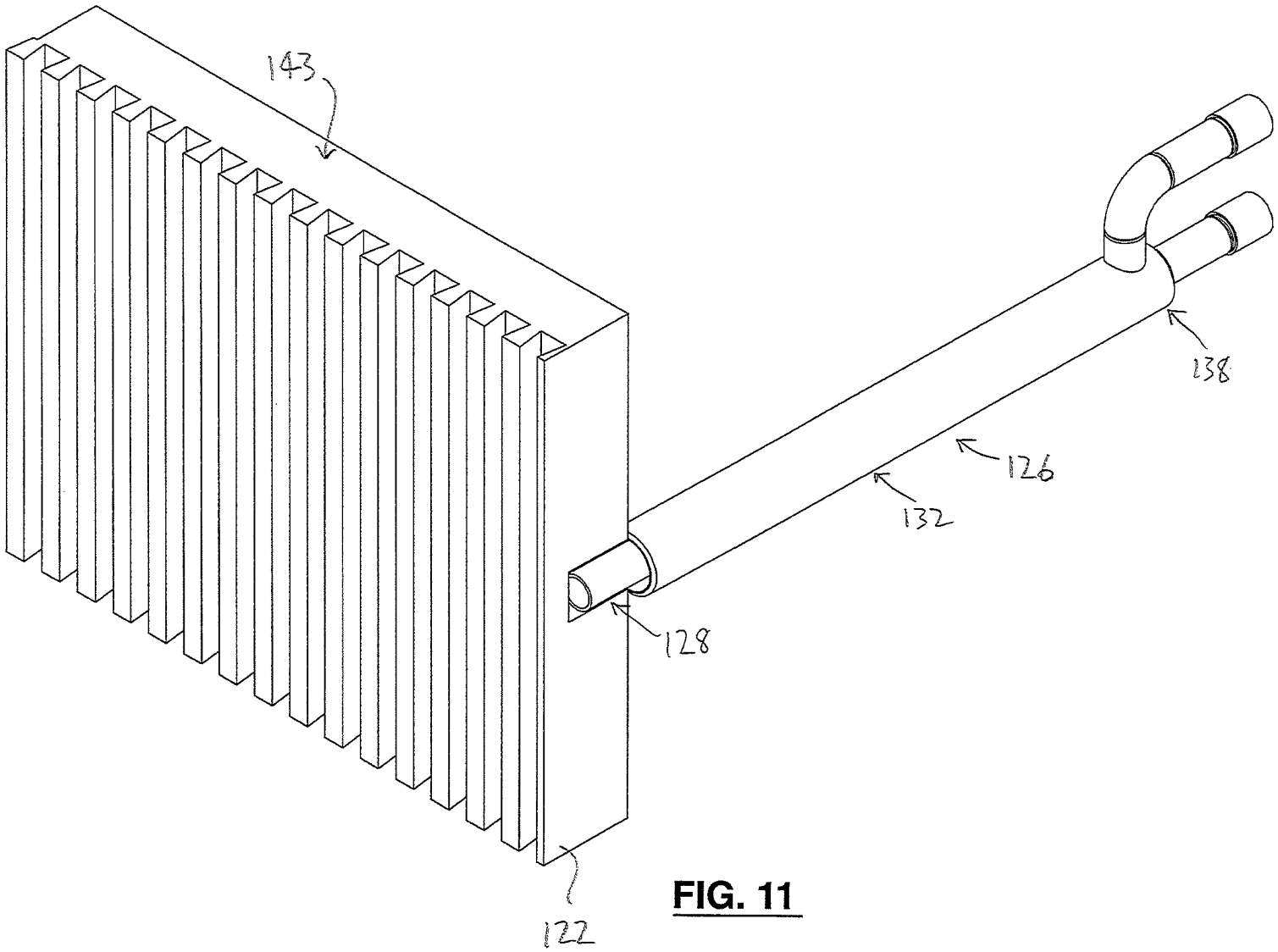
FIG. 11 is an isometric view of an alternative embodiment of a stave cooler assembly of the invention positioned in a stave, drawn at a smaller scale.
Figure 12:
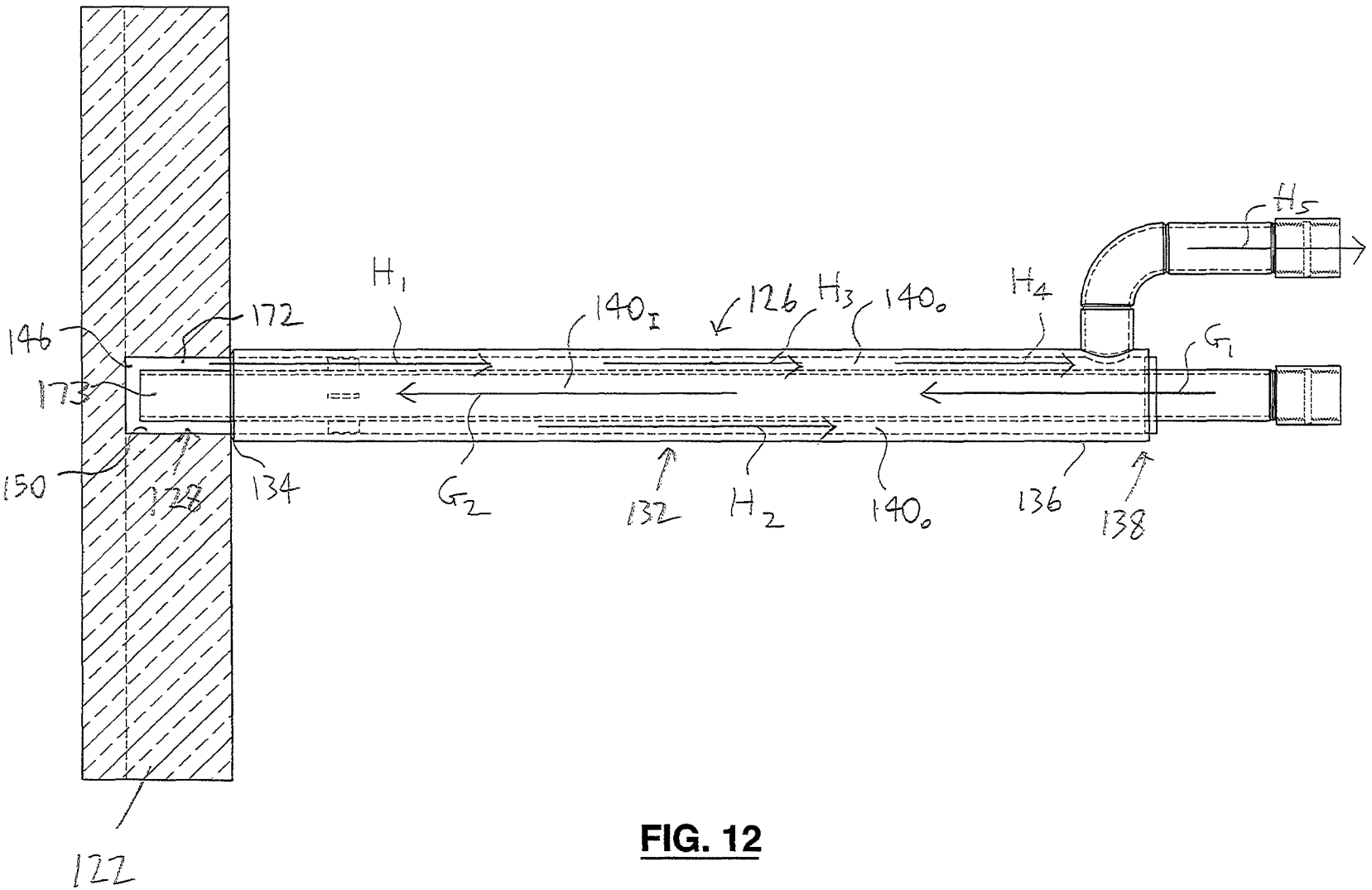
FIG. 12 is a cross-section of the stave cooler assembly and the stave of FIG. 11.
Figure 13:
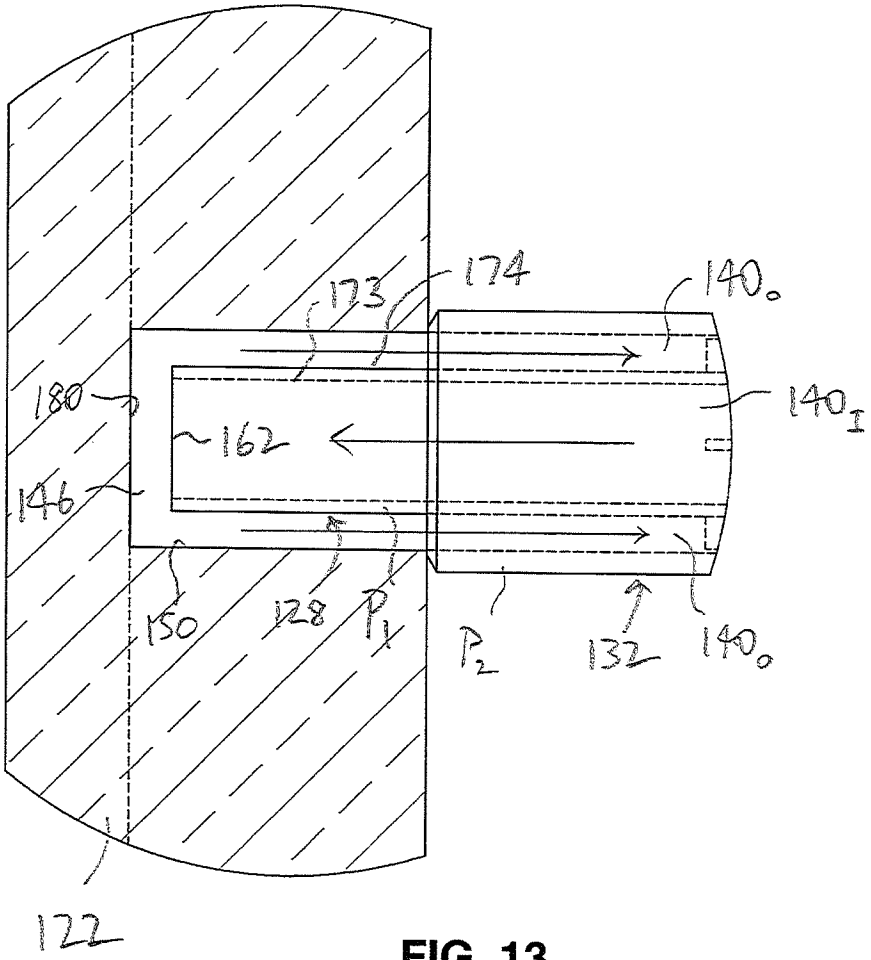
FIG. 13 is a cross-section of an inner end portion and part of a central portion of the stave cooler assembly of FIG. 12, drawn at a larger scale.
Figure 14:
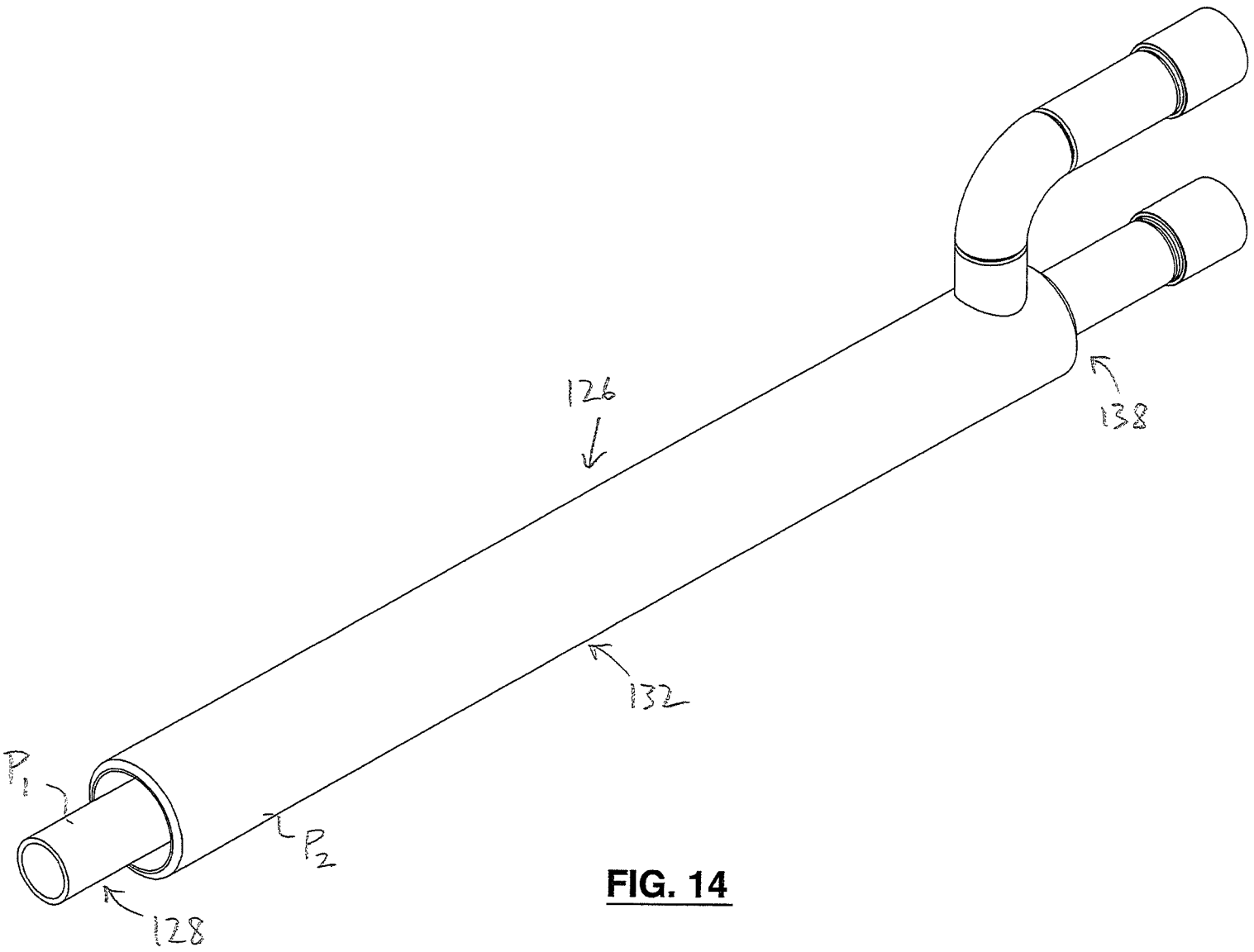
FIG. 14 is an isometric view of the stave cooler assembly of FIG. 11, drawn at a smaller scale.
Figure 15:
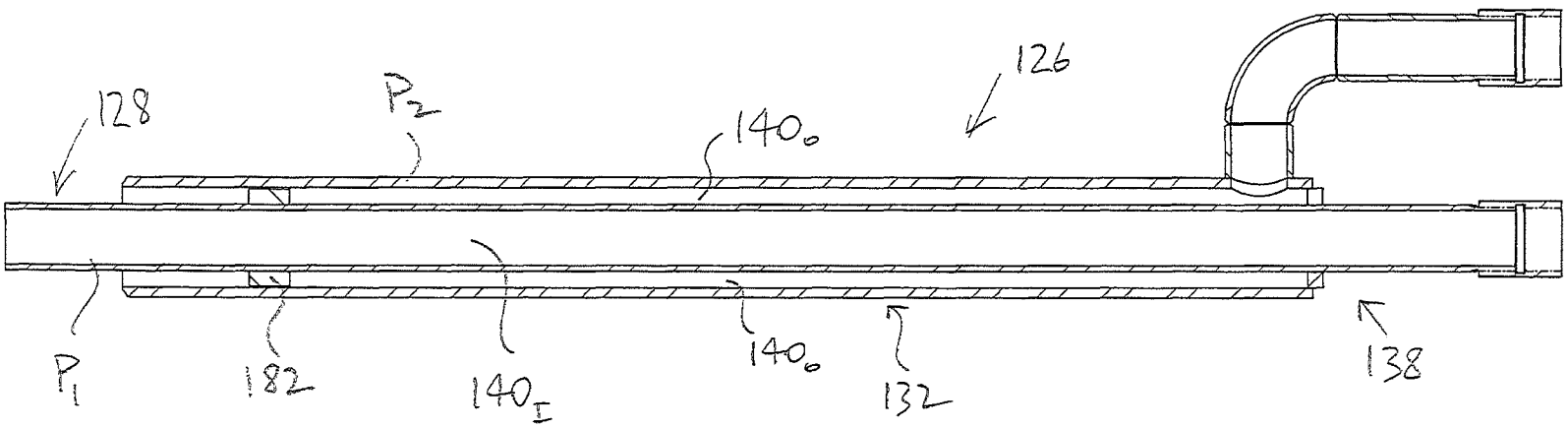
FIG. 15 is a cross-section of the stave cooler assembly of FIG. 14.
Figure 16:
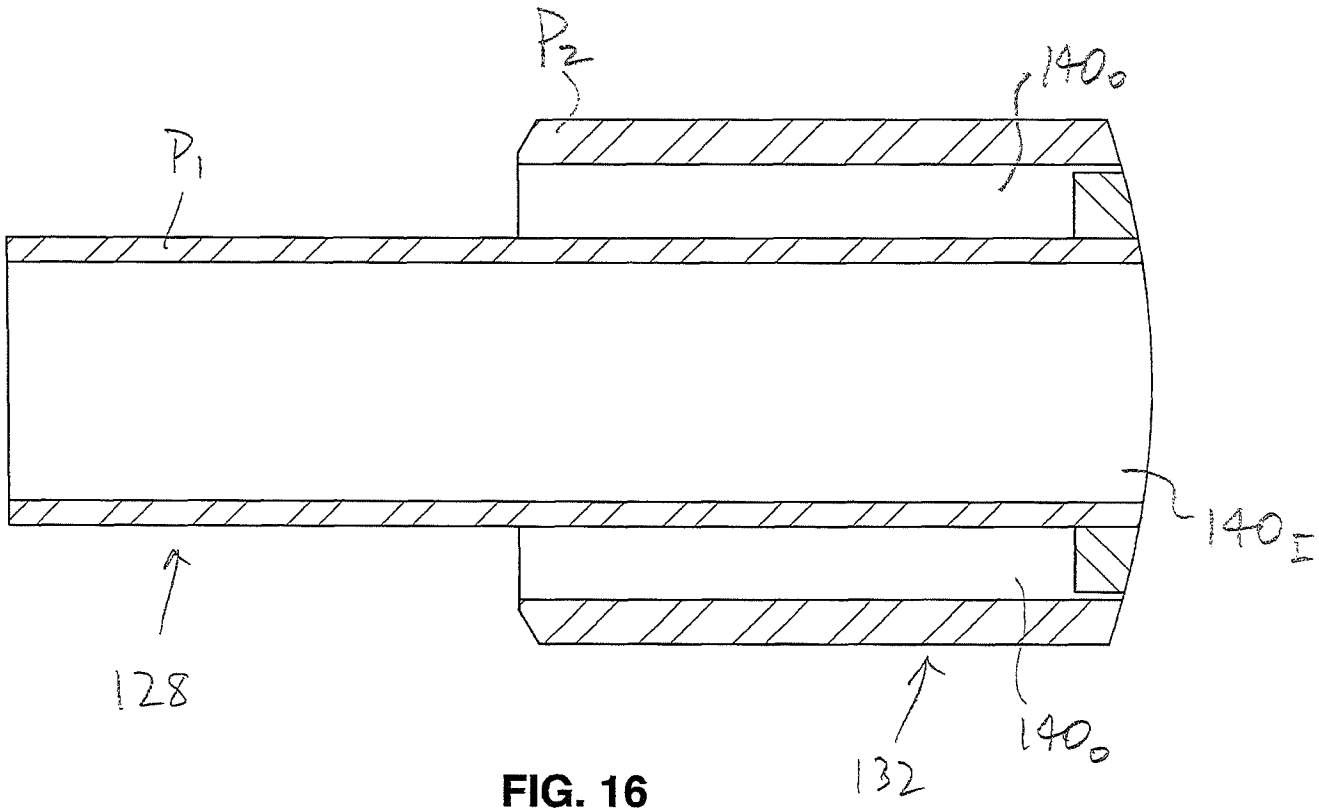
FIG. 16 is a cross-section of the inner end portion and a part of the central portion of the stave cooler assembly of FIG. 14, drawn at a larger scale.

The invention also includes an embodiment thereof, illustrated in FIGS. 11-17, in which a stave cooler assembly 126 preferably is partially positioned in the stave assembly 143, prior to installation of the stave assembly 143 in a metallurgical furnace (not shown in FIGS. 11-17). In one embodiment, the stave cooler assembly 126 is partially positioned in one or more staves or cooling elements 122 mountable in the metallurgical furnace (FIGS. 11-13). The stave cooler assembly 126 preferably includes an inner end portion 128 spaced apart from the stave 122 by a predetermined distance, to define a gap 172 therebetween, and an elongate central portion 132 extending between distal and proximal ends 134, 136 thereof, the inner end portion 128 being positioned at the distal end 134. The stave cooler assembly 126 preferably also includes an outer end portion 138 secured to the central portion 132 at the proximal end 136 thereof. The stave cooler assembly 126 preferably also includes one or more inflow conduits $\mathbf{140}_I$ and one or more outflow conduits $\mathbf{140}_O$ through which a coolant (not shown) is movable.

As will be described, the gap 172 is provided so that the coolant may be circulated therethrough.

As can be seen in FIGS. 12 and 13, in one embodiment, the inner end portion 128 includes a terminal part 173 of a pipe "$P_1$" that extends through the central portion 132 to the outer end portion 138, to define the input conduit $\mathbf{140}_I$.

The stave cooler assembly 126 preferably is installed in the stave assembly 143 before the stave assembly 143 is installed in the metallurgical furnace. Accordingly, it can be seen that the stave cooler assembly 126 is intended for use as a precautionary measure, because it is anticipated that the stave assembly 143 will eventually deteriorate, i.e., due to normal usage in the metallurgical furnace.

It is preferred that the stave assembly 143 is mounted in the metallurgical furnace, with the inner end portion 128 of the stave cooler assembly 126 positioned therein. After the metallurgical furnace has operated for a period of time, the stave assembly may deteriorate, as described above. If so, then an external segment of the outer end portion 138 is connected with the pump assembly (not shown in FIGS. 11-17), to circulate the coolant through the stave cooler assembly 126, as described above. In this way, the useful life of the stave assembly 143 may be extended.

In order to permit the inner end portion 128 of the stave cooler assembly 126 to be positioned in the stave assembly 143, an inner part 146 is formed in the stave 122, partially defined by an inner hole wall 150 (FIGS. 12, 13).

As can be seen in FIG. 13, the gap 172 is defined, in part, by a side 174 of the inner end portion 128 (i.e., of the terminal part 173 of the pipe "$P_1$"), and also in part by the inner hole wall 150 that opposes the side 174. Also, the gap 172 is partially defined by an end 162 of the terminal part 173 of the pipe "$P_1$" and an end wall 180 of the inner part 146.

Figure 17:
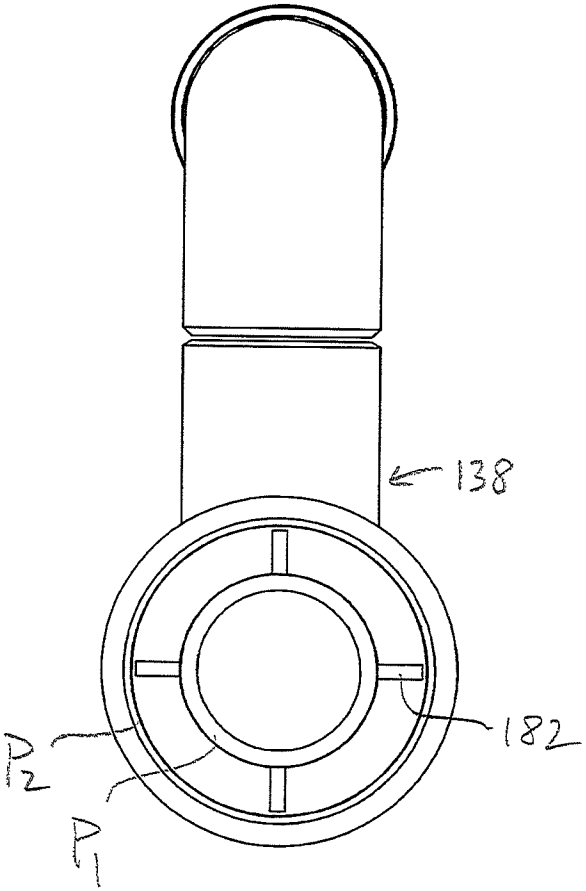
FIG. 17 is an end portion of the stave cooler assembly of FIG. 14 from the inner end portion, drawn at a smaller scale.

The pipe "$P_1$" preferably is held in position inside a larger pipe "$P_2$" that is included in the central portion 132 and in the outer end portion 138. As can be seen in FIG. 17, in one embodiment, the pipe "$P_1$" preferably is supported in position by spacer elements 182 between the inner wall of the exterior pipe "$P_2$" and the outer wall of the interior pipe "$P_1$".

As can be seen in FIG. 12, the coolant (not shown) preferably is introduced into the input conduit $\mathbf{140}_I$, pumped by a pump assembly (not shown) connected thereto. The coolant flows inwardly via the input conduit $\mathbf{140}_I$, as schematically represented by arrows "$G_1$" and "$G_2$" (FIGS. 12, 13). When the incoming coolant reaches the end wall 180, the coolant is directed thereby outwardly through the gap 172 between the sides 174, 176 and the inner hole wall 150, and into the output conduit $\mathbf{140}_O$, as schematically indicated by arrows "$H_1$"-"$H_5$" (FIGS. 12, 13).

It will be understood that, because the incoming coolant is in direct contact with the end wall 180 and the inner hole wall 150, heat transfer from the stave 122 to the coolant is relatively efficient.

In another embodiment, the method of the invention includes forming the hole (i.e., the inner part 146) defined by the bore wall 150 in the stave or cooling element 122 having a predetermined diameter, to partially define the gap 172 between the bore wall and the inner end portion. The inner end portion 128 is then positioned in the inner part 146 of the hole.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A stave cooler system for cooling at least one cooling element mounted in a metallurgical furnace, the system comprising:

said at least one cooling element comprising a preselected part in which an inner part of a hole is formed, the inner part being defined by an inner hole wall extending from an outer wall of said at least one cooling element into the preselected part of said at least one cooling element;

a stave cooler assembly comprising:

an inner end portion comprising an end part comprising a body and a plurality of fins extending from the body, each said fin comprising an outer part thereof and an inner part thereof connecting the outer part and the body;

each said fin being formed to bend upon engagement of the outer part of each said fin respectively with the inner hole wall at the outer wall, to securely engage the outer part of each said fin with the inner hole wall when the end part is inserted into the inner part of the hole;

an elongate central portion extending between distal and proximal ends thereof connected with the inner end portion at its distal end;

an outer end portion secured to the central portion at the proximal end thereof;

at least one conduit extending through the central portion and the inner end portion, a fluid coolant being circulatable through said at least one conduit, for transfer of heat generated in the metallurgical furnace from said at least one cooling element to the coolant at least partially by conduction via the outer parts of the bent fins engaging the inner hole wall; and a source of the coolant.

2. The stave cooler system according to claim 1 additionally comprising a pump assembly for circulating the coolant through said at least one conduit.

3. The stave cooler assembly according to claim 2 in which:

the inner hole wall has an area thereof that partially defines the inner part of the hole; and once the end part is positioned in the inner part, the fins engage more than 50 percent of the area of the inner hole wall.

4. The stave cooler assembly according to claim 3 in which, once the end part is positioned in the inner part, the fins engage at least 70 percent of the area of the inner hole wall.

5. The stave cooler system according to claim 1 additionally comprising a positioning assembly for holding the end part of the inner end portion in the inner part of the hole, for heat transfer from said at least one cooling element to the coolant via the end part.

6. The stave cooler system according to claim 2 in which the inner part comprises a tapered segment thereof in which a diameter of the tapered segment increases from an inner end thereof outwardly.

7. The stave cooler system according to claim 2 in which the inner part comprises a tapered segment thereof extending between an inner end and an outer end of the inner part, a diameter of the tapered segment increasing from the inner end to the outer end.

8. The stave cooler system according to claim 2 in which the end part comprises a main part extending between an inner end and an outer end thereof and the fins extend from the body by respective predetermined lengths prior to insertion of the end part into the inner part, said predetermined lengths increasing from the inner end of the main part to the outer end of the main part.

9. The stave cooler system according to claim 5 additionally comprising:

a flange mounted to the inner end portion and spaced outwardly from the end part;

an inner plate mounted to the inner end portion and spaced outwardly from the flange, the inner plate being secured to said at least one cooling element; and at least one inner positioning element located between the flange and the inner plate, for urging the flange inwardly relative to said at least one cooling element, to maintain the end part in the inner part of the hole.

10. The stave cooler system according to claim 5 additionally comprising:

a collar mounted to the outer end portion and spaced outwardly from a shell of the metallurgical furnace;

an outer plate mounted to the outer end portion and spaced outwardly from the collar, the outer plate being secured to the shell; and at least one outer positioning element located between the collar and the outer plate, for urging the collar inwardly, to maintain the end part in the inner part of the hole.

* * * * *